US009731890B2

(12) United States Patent
Ophardt et al.

(10) Patent No.: US 9,731,890 B2
(45) Date of Patent: Aug. 15, 2017

(54) PUMP MAINTAINING CONTAINER INTERNAL PRESSURE

(71) Applicant: OP-Hygiene IP GmbH, Niederbipp (CH)

(72) Inventors: Heiner Ophardt, Arisdorf (CH); Andrew Jones, Smithville, CA (US)

(73) Assignee: OP-Hygiene IP GmbH, Niederbipp (CH)

( * ) Notice: Subject to any disclaimer, the term of this patent is extended or adjusted under 35 U.S.C. 154(b) by 45 days.

(21) Appl. No.: 14/684,234

(22) Filed: Apr. 10, 2015

(65) Prior Publication Data

US 2015/0291345 A1 Oct. 15, 2015

(30) Foreign Application Priority Data

Apr. 11, 2014 (CA) ..... 2848857

(51) Int. Cl.

| | |
|---|---|
| ***B67D 7/76*** | (2010.01) |
| ***B65D 83/14*** | (2006.01) |
| ***A47K 5/12*** | (2006.01) |
| ***A47K 5/14*** | (2006.01) |
| ***B05B 7/00*** | (2006.01) |
| *B05B 11/00* | (2006.01) |

(52) U.S. Cl.

CPC ..... *B65D 83/14* (2013.01); *A47K 5/1207* (2013.01); *A47K 5/14* (2013.01); *B05B 7/0037* (2013.01); *B05B 11/3087* (2013.01); *B05B 11/0016* (2013.01)

(58) Field of Classification Search

CPC ..... B65D 83/14; A47K 5/14; A47K 5/1207; B05B 11/0016; B05B 11/3087; B05B 7/0037

USPC ..... 222/190, 321.1–321.9, 181.3, 185.1, 183

See application file for complete search history.

(56) References Cited

U.S. PATENT DOCUMENTS

| | | | | |
|---|---|---|---|---|
| 5,676,277 | A | 10/1997 | Ophardt | |
| 6,082,586 | A * | 7/2000 | Banks | A47K 5/14 222/105 |
| D530,123 | S | 10/2006 | Ophardt et al. | |
| 7,267,251 | B2 | 9/2007 | Ophardt | |
| 7,303,099 | B2 | 12/2007 | Ophardt | |
| RE40,319 | E | 5/2008 | Ophardt et al. | |
| D568,659 | S | 5/2008 | Ophardt et al. | |
| 7,661,561 | B2 | 2/2010 | Ophardt et al. | |
| 7,735,686 | B2 | 6/2010 | Ophardt | |
| 7,748,574 | B2 | 7/2010 | Ophardt et al. | |
| 7,815,076 | B2 | 10/2010 | Ophardt | |
| 7,823,751 | B2 | 11/2010 | Ophardt et al. | |
| 7,861,898 | B2 | 1/2011 | Ophardt | |
| 7,959,037 | B2 | 6/2011 | Ophardt et al. | |
| 8,056,772 | B2 | 11/2011 | Ophardt et al. | |
| 8,157,134 | B2 | 4/2012 | Ophardt et al. | |
| 8,360,286 | B2 | 1/2013 | Shi et al. | |
| 8,365,965 | B2 | 2/2013 | Ophardt | |

(Continued)

FOREIGN PATENT DOCUMENTS

| | | |
|---|---|---|
| WO | 2015038692 | 3/2015 |

*Primary Examiner* — Lien Ngo

(74) *Attorney, Agent, or Firm* — Thorpe North & Western LLP

(57) ABSTRACT

A piston pump for dispensing fluid from a closed container in which during the cycle of operation to dispense fluid, atmospheric air is discharged into the reservoir towards reducing a vacuum that might otherwise be created within the container.

21 Claims, 17 Drawing Sheets

(56) References Cited

U.S. PATENT DOCUMENTS

| | | | | |
|---|---|---|---|---|
| 8,474,664 | B2 | 7/2013 | Ophardt et al. | |
| 8,622,243 | B2 | 1/2014 | Ophardt et al. | |
| 8,893,932 | B2 | 11/2014 | Ophardt et al. | |
| 8,919,611 | B2 | 12/2014 | Ophardt et al. | |
| 2005/0161476 | A1 | 7/2005 | Ophardt | |
| 2006/0237483 | A1 | 10/2006 | Ophardt | |
| 2007/0251953 | A1 | 11/2007 | Criswell | |
| 2011/0240680 | A1 | 10/2011 | Ophardt et al. | |
| 2013/0336823 | A1 | 12/2013 | Ophardt et al. | |
| 2014/0099224 | A1 | 4/2014 | Ophardt et al. | |
| 2014/0217123 | A1 | 8/2014 | Ophardt et al. | |
| 2015/0173568 | A1* | 6/2015 | Harris | A47K 5/1211 222/190 |

* cited by examiner

PUMP MAINTAINING CONTAINER INTERNAL PRESSURE

SCOPE OF THE INVENTION

This invention relates to dispensers for dispensing fluid from a closed container and, more particularly, to dispensers of hand cleaning fluids.

BACKGROUND OF THE INVENTION

Dispensers are known for dispensing fluids from bottles which are enclosed other than for an opening through which the fluid is to be dispensed. Various arrangements arise for relieving vacuum which may develop within the bottle. A disadvantage arises in prior art devices that to maintain the bottle in the shape and appearance that occurs when full, the bottle needs to be provided with sufficient strength to resist collapse when a vacuum condition may be developed within the interior of the bottle.

One-way vacuum release valves are known which provide in the condition that a substantial vacuum is developed within a bottle, that the one-way relief valve may permit air to enter the bottle towards relieving the vacuum within the bottle. Such one-way relief valves suffer the disadvantage that generally a relatively substantial vacuum needs to be developed in the bottle for the air valve to be effective and that the vacuum which is created in the bottle typically requires the bottle to at least be somewhat resistant to collapse under vacuum conditions.

Fluid dispensers are known in which the fluid is contained within a collapsible bottle or a flexible plastic bag. The use of such collapsible bottles and collapsible bags suffer the disadvantage that during the collapse, the bottle or bag may collapse in a manner that it traps fluid in portions of the bottle which cannot then be dispensed and is wasted. Additionally, the collapse of the bottle or bag can provide the bottle or bag with an unsightly appearance.

SUMMARY OF THE INVENTION

To at least partially overcome these disadvantages of previously known devices, the present invention provides a piston pump for dispensing fluid from a closed container in which during the cycle of operation to dispense fluid, atmospheric air is discharged into the reservoir towards reducing a vacuum that might otherwise be created within the container.

In one aspect, the present invention provides a dispenser for dispensing fluid from a container comprising:

a container having a container outlet opening, the container closed other than the container outlet opening, a fluid in the container, a pump mechanism including a fluid pump and a replenishing air pump, the fluid pump in communication with fluid in the container through the container outlet opening, the fluid pump receiving the fluid from the container and discharging the fluid from the container out a discharge outlet, the fluid pump comprising a piston pump with a fluid piston and a fluid chamber casing forming a fluid chamber within which the fluid piston is reciprocally slidable relative the fluid chamber casing along a fluid axis in a cycle of operation to draw the fluid from the container and discharge the fluid out the discharge outlet, the fluid pump in communication with fluid in the container through the container outlet opening, the fluid pump receiving the fluid from the container and discharging the fluid from the container out the discharge outlet, the replenishing air pump comprising a piston pump with a replenishing air piston and a replenishing air chamber casing forming a replenishing air chamber within which the replenishing air piston is reciprocally slidable along a replenishing air axis in the cycle of operation to draw air from the atmosphere and discharge the air into the container via the outlet opening, the fluid axis and the replenishing air axis are parallel, the replenishing air piston is fixed to the fluid piston for movement in unison together, the replenishing air chamber casing is fixed to the fluid chamber casing for movement in unison together.

DETAILED DESCRIPTION OF THE DRAWINGS

Figure 1:
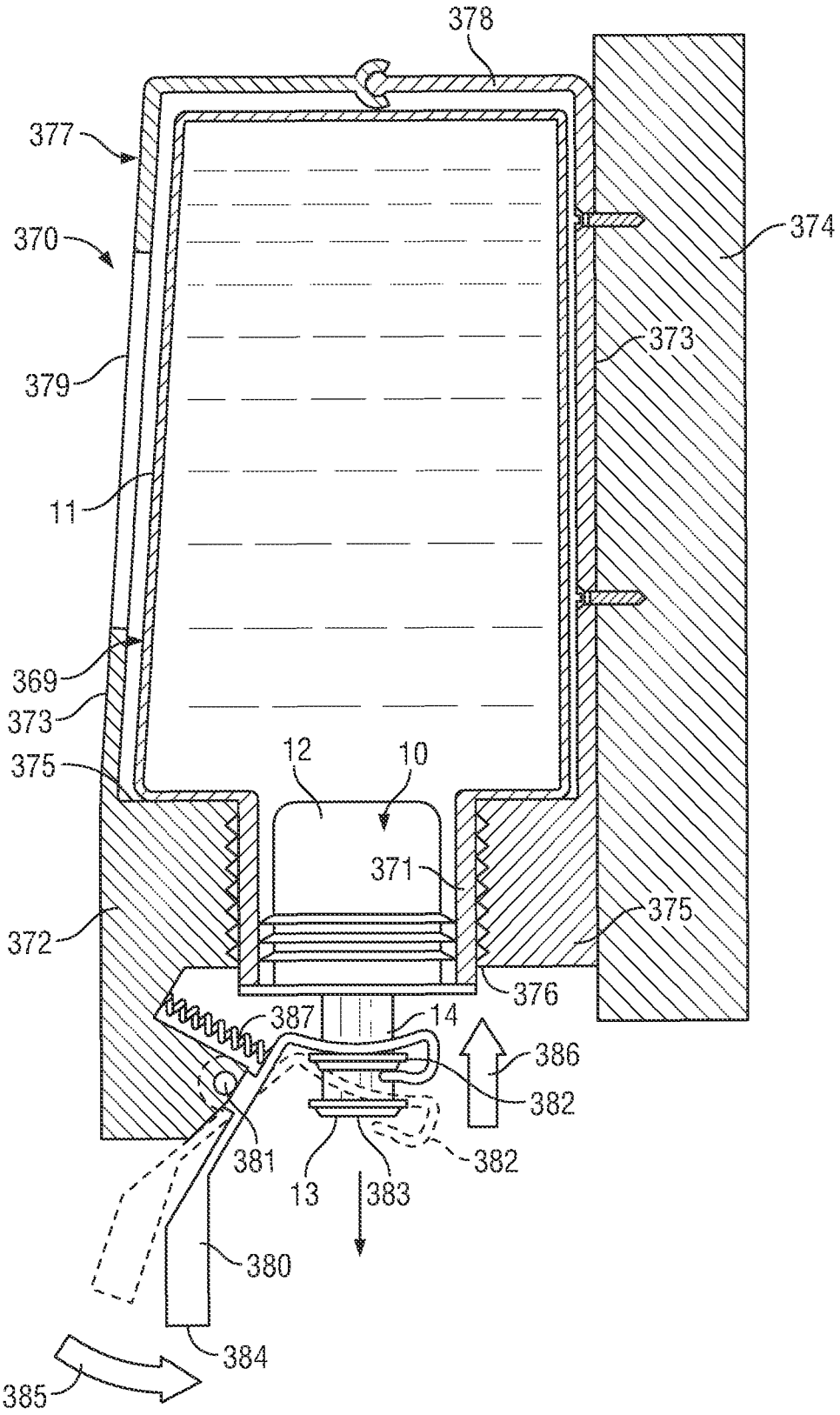
FIG. 1 is a partially cut away side view of a preferred embodiment of a fluid dispenser with the reservoir and pump assembly in accordance with the present invention.

Reference is made first to FIGS. 2 to 5 which show a pump assembly 10 in accordance with a first embodiment of the present invention. Pump assembly 10 comprises two principle components, namely, a piston chamber-forming member or body 12 and a piston-forming element or piston 14. The pump assembly 10 is schematically shown as coupled to a container or reservoir 11. The reservoir 11 is closed other than at an opening 101 through a threaded neck 102. The pump assembly 11 is sealably engaged to the reservoir 11 to close the opening 101 and prevent flow into or out of the reservoir 11 other than through the pump assembly 10. As seen, a threaded collar 103 on the body 12 of the pump assembly 10 engages the threaded neck 102 of the reservoir 11.

The pump assembly 10 provides three pumps, namely, a fluid pump 20, a replenishing air pump 120 and a discharge air pump 220.

The fluid pump 20 draws fluid from the reservoir 11 and discharges fluid to the discharge outlet 13. The replenishing air pump 120 draws in atmospheric air and discharges such air into the reservoir 11. The discharge air pump 220 draws in atmospheric air and discharges such air out the discharge outlet 13. The piston 14 is coaxially reciprocally slidable relative to the body 12 in a cycle of operation including a retraction stroke and an extension stroke. In the retraction stroke, the piston 14 moves from the extended position of FIG. 2 to the retracted position of FIG. 3. In the extension stroke, the piston 14 moves from the retracted position of FIG. 3 to the extended position of FIG. 2. In this cycle of operation, preferably, the fluid pump 20 draws a volume of fluid from the reservoir 11 and the replenishing air pump 120 discharges into the container a volume of air equal to the volume of fluid discharged in that stroke such that a reservoir volume within the reservoir 11 after a cycle of operation is the same at the beginning of the cycle of operation as after the cycle of operation and the reservoir volume is preferably maintained constant over time during a plurality of successive cycles of operation assuming a constant ambient temperature. The reservoir volume is the volume within the reservoir and is a sum of a volume of the fluid within the reservoir 11 and a volume of gas within the reservoir 11. The gas within the reservoir is notably air but may include vapour of the fluid up to its partial pressure at the ambient temperature. Changes in temperature will change at least the volume of gasses, notably the air in the reservoir.

In the first preferred embodiment of FIGS. 2 to 5, the fluid pump 20 draws a dose of fluid from the reservoir 11 in a withdrawal stroke and the replenishing air pump 120 in a retraction stroke discharges a dose of air into the reservoir 11. During a retraction stroke, as the fluid is discharged by the fluid pump 20, the discharge air pump 220 operates simultaneously such that fluid from the reservoir 11 and air from the discharge air pump 220 are simultaneously discharged into a mixing chamber 15 within the piston 14, and then simultaneously passed through a foam generating screen 16 and hence out the discharge outlet 13 as a mixture of fluid and air as foam. In the simultaneous passage of air and liquid through the foaming screen 16, preferably the fluid is a fluid capable of foaming and turbulence is produced which generates foam which is discharged out the discharge outlet 13. Any suitable foam generating mechanism may be used and the invention is not limited to merely using a screen as the foam producing mechanism. As well, a nozzle arrangement could be substituted for the foaming screen 16 to discharge a mist of air and small fluid droplets simultaneously from the discharge outlet 13.

During one cycle of operation, and during many successive cycles of operation of the pump assembly 10, with the amount of fluid being drawn from the reservoir 11 by the fluid pump 20 is preferably substantially the same in each cycle of operation as the volume of air being discharged into the reservoir 11, and thus the reservoir volume is preferably maintained substantially constant with the reservoir 11 in a full condition avoiding a vacuum being created within the reservoir 11 sufficient that the reservoir 11 will collapse to a collapsed or partially collapsed condition. Preferably in operation of the dispenser the shape and appearance of the reservoir 11 is maintained constant in the full condition.

The reservoir 11 may be a container preferably of plastic material which will collapse when vacuum conditions exist its interior as compared to ambient atmospheric pressure. However, the reservoir 11 may be a container which does not collapse when vacuum conditions exist its interior. Advantageously, in accordance with the present invention, the reservoir 11 is a container which will collapse when vacuum conditions exist in its interior, however, the pump assembly 10 is operative to prevent vacuum conditions from existing in the interior of the reservoir which would collapse the reservoir 11.

Maintaining the relative shape and appearance of the reservoir 11 proximate the full condition has a number of advantages. Firstly, with the reservoir 11 maintained in the full condition, the reservoir 11 does not collapse so as, for example, to restrict the flow of fluid within the reservoir 11 to the fluid pump 20. With the reservoir 11 in a full condition, the level of fluid within the reservoir 11 is indicative of the extent to which the reservoir 11 may be full or empty of the fluid. With the reservoir 11 maintained in the full condition, the appearance of the reservoir 11 frequently is enhanced over an appearance of the reservoir when the reservoir 11 when in a collapsed or partially collapsed condition. Providing the reservoir 11 to be maintained in a substantially full condition has the advantage of permitting the reservoir 11 to have a lesser inherent ability to maintain the full condition when a vacuum exists in its interior and permits, for example, reservoirs to be used of constructions, for example, requiring less plastic material or having thinner walls than a reservoir which needs to have and maintain an inherent shape that prevents or resists collapse when a vacuum exists in its interior.

Referring again to FIGS. 2 to 5, the body 12 carries a fluid chamber casing 21 for the fluid pump 20. The fluid chamber casing 21 has a cylindrical wall 22 about an axis 23. The cylindrical wall 22 provides a radially inwardly directed surface 24 and defines a fluid chamber 25 therein. The fluid chamber 25 has a large opening 26 at an outer end 27 and a fluid inlet 28 at an inner end 29. A one-way fluid inlet valve 30 is disposed across the fluid inlet 28 between the fluid chamber 25 and the reservoir 11.

The piston 14 carries as part of the liquid pump 20, a fluid piston 31 adapted to be coaxially slidable along the axis 23 within the chamber 25. The piston 14 carries at an inner end 32 a pair of sealing discs 33 each of which is generally circular in cross-section normal the axis 23 and extends radially outwardly to a flexible distal end 34 which engages the surface 24 of the cylindrical wall 22 of the fluid chamber casing 21 such that the sealing discs 33 together form seals preventing fluid flow inwardly or outwardly therepast between the sealing disc 33 and the cylindrical wall 22. The fluid piston 31 has a hollow stem 35 with a central passageway 36 axially therethrough from the inner end 32 to a fluid outlet 37 opening into the mixing chamber 15. Within an enlarged lower portion 38 of the central passageway 36, a one-way fluid outlet valve 39 is provided.

The one-way fluid inlet valve 30 provides for fluid flow outwardly from the reservoir 11 into the fluid chamber 25 and prevents fluid flow from the fluid chamber 25 back to the reservoir 11. The one-way fluid outlet valve 39 provides for fluid flow from the central passageway 36 outwardly to the mixing chamber 15 and prevents fluid flow from the mixing chamber 15 to the fluid chamber 25.

A fluid compartment 61 is defined within the fluid chamber 25 between the fluid casing 21 and the fluid piston 31 in between the one-way fluid inlet valve 30 and the one-way fluid outlet valve 39 with a volume of the fluid compartment 61 changing with relative axial movement of the piston 14 relative to the body 12. As is to be appreciated, in a retraction stroke, the volume of the fluid compartment 61 decreases and the pressure within the fluid compartment 61 increases which closes the one-way fluid inlet valve 30 and opens the one-way fluid outlet valve 39 such that the fluid pump 20 discharges fluid to the mixing chamber 15 and hence to the discharge outlet 13. In a withdrawal stroke, a volume of the fluid compartment 61 increases creating a vacuum within the fluid compartment 61 which closes the one-way fluid outlet valve 39 and opens the one-way fluid inlet valve 30 drawing fluid from the reservoir 11 through the fluid inlet 28 into the fluid chamber 25.

The fluid inlet 28 is formed by a cylindrical tube 62 open both at an inner end and at an outer end. A valve member 65 is located within the tube 62 with a radially inwardly extending flange 66 of the tube 62 being engaged in a radially outwardly extending annular groove about the valve member 65 formed between a first shoulder 63 and a radially extending locating flange 69. The valve member 65 carries an annular seal disc 68 which extends radially outwardly to engage a radially inwardly directed surface of the tube 62. A distal end 70 of the sealing disc 68 engages the surface of the tube 62 in a manner to prevent fluid flow inwardly therepast when the pressure within the fluid chamber 25 is greater than the pressure within the reservoir 11. However, when the pressure within the reservoir 11 is greater than the pressure within the fluid chamber 25, the seal disc 68 deflects radially inwardly to permit fluid flow from the reservoir 11 into the fluid chamber 25 to permit fluid flow therepast. Inwardly from the seal disc 68, openings are provided axially through both the locating flange 69 of the valve member 65 and the flange 66 of the tube 62 preventing unrestricted fluid flow axially between the reservoir 11 and the radially outer and axially inner side of the seal disc 68.

Preferably, the valve member 65 is formed of a resilient material and the seal disc 68 may, to some extent, be inherently biased as to engagement with the surface of the tube 62.

The one-way fluid outlet valve 39 comprises a valve member 65 identical to the valve member 65 of the one-way fluid inlet valve 30 and similar reference numerals are used to refer to similar elements. The valve member 65 of the one-way fluid outlet valve 39 is constrained axially within the enlarged portion 38 of the central passageway 36 between an axial inner end of the enlarged portion 38 and an outer end wall 64 with the locating flange 69 assisting in coaxially locating the valve member 65 coaxially in the enlarged portion 38. On the side of the locating flange 69 opposite from the seal disc 68, the valve member 65 has a tubular extension 71 with a central passage 72 closed at a blind end by the locating flange 69 and open at an inner distal end 73. A radially extending port 74 extends radially through the wall of the tubular extension 71. Fluid is free to flow from the central passageway 36 into the passage 72 and radially through the port 74 to the radially outer and axially inner side of the seal disc 68. The enlarged portion 38 of the central passageway 36 provides a radially inwardly directed surface 75. The valve member 65 carries the annular seal disc 68 which extends radially outwardly to engage the radially inwardly directed surface 75. The distal end 70 of the seal disc 68 engages the surface 75 in a manner to prevent fluid flow inwardly therepast when the pressure within the mixing chamber 16 is greater than the pressure within the fluid chamber 25. However, when the pressure within the fluid chamber 25 is greater than the pressure within the mixing chamber 16, the seal disc 68 deflects radially inwardly to permit fluid flow therepast from the fluid chamber 25 into the mixing chamber 16.

Referring again to FIGS. 2 to 5, the body 12 carries a replenishing air chamber casing 121 for the replenishing air pump 120. The replenishing air chamber casing 121 has a cylindrical wall 122 about an axis 123. The cylindrical wall 122 provides a radially inwardly directed surface 124 and defines a replenishing air chamber 125 therein. The replenishing air chamber 125 has a large opening 126 at an outer end 127 and a replenishing air outlet 128 at an inner end 129. A one-way replenishing air outlet valve 130 is disposed across the replenishing air outlet 128 between the replenishing air chamber 125 and the reservoir 11. The piston 14 carries as part of the replenishing air pump 120, a replenishing air piston 131 adapted to be coaxially slidable along the axis 123 within the replenishing air chamber 125. The replenishing air piston 131 carries at an inner end 132 a pair of sealing discs 133 each of which is generally circular in cross-section normal the axis 123 and extends radially outwardly to a flexible distal end 134 which engages the surface 124 of the cylindrical wall 122 of the replenishing air chamber casing 121 such that the sealing discs 133 form a seal preventing air flow inwardly or outwardly therepast between the sealing discs 133 and the cylindrical wall 122. The replenishing air piston 131 has a hollow stem 135 with a central passageway 136 axially therethrough from the inner end 132 to a replenishing air inlet 137 open to the atmosphere. Within an enlarged lower portion 138 of the central passageway 136, a one-way replenishing air inlet valve 139 is provided.

The one-way replenishing air outlet valve 130 provides for air flow inwardly from the replenishing air chamber 125 into the reservoir 11 and prevents flow from the reservoir 11 to the replenishing air chamber 125. The one-way replenishing air inlet valve 139 provides for replenishing air flow from the atmosphere inwardly to the replenishing air chamber 125 and prevents flow from the replenishing air chamber 125 to the atmosphere.

A replenishing air compartment 161 is defined within the replenishing air chamber 125 between the replenishing air casing 121 and the replenishing air piston 131 in between the one-way replenishing air inlet valve 139 and the one-way replenishing air outlet valve 130 with a volume of the replenishing air compartment 161 changing with relative axial movement of the piston 14 relative to the body 12. As is to be appreciated, in a retraction stroke, the volume of the replenishing air compartment 161 decreases and pressure increases within the replenishing air compartment 161 which closes the one-way replenishing air inlet valve 139 and opens the one-way replenishing air outlet valve 130 such that the replenishing air pump 120 discharges air to the reservoir 11. In a withdrawal stroke, the volume of the replenishing air compartment 161 increases creating a vacuum within the replenishing air compartment 161 which closes the one-way replenishing air outlet valve 130 and opens the one-way replenishing air inlet valve 139 drawing air from the atmosphere through the replenishing air inlet 137 into the replenishing air chamber 125.

The replenishing air outlet 128 is formed by a cylindrical tube 162 open both at an inner end and at an outer end. A valve member 65 is located within the tube 162. The valve member 65 of the one-way replenishing air outlet valve 128 is identical to the valve members 65 of the fluid pump 20, however, is held in a position inverted compared to the valve member 65 in the fluid pump 20. A radially inwardly extending flange 166 of the tube 162 is engaged in a radially outwardly extending annular groove about the valve member 65 formed between the first shoulder and the radially extending locating flange 69. The valve member 65 carries the annular seal disc 68 which extends radially outwardly to engage a radially inwardly directed surface 169 of the tube 162. The distal end 70 of the seal disc 68 engages the surface 169 of the tube 162 in a manner to prevent fluid flow outwardly therepast when the pressure within the reservoir 11 is greater than the pressure within the replenishing air chamber 125. However, when the pressure within replenishing air chamber 125 is greater than the pressure within the reservoir 11, the seal disc 68 deflects radially inwardly to permit air flow from the replenishing air chamber 125 into the reservoir 11. Inwardly from the seal disc 68, openings are provided axially through the both the locating flange 69 of the valve member 65 and the flange 166 of the tube 162 providing unrestricted fluid flow axially between the replenishing air chamber 125 and the radially outer and axially inner side of the valve member 65.

Preferably, the valve member 65 is formed of a resilient material and the seal disc 68 may, to some extent, be inherently biased as to engagement with the surface 169.

The one-way replenishing air inlet valve 139 comprises a valve member 65 identical to the valve member 65 of the one-way replenishing air outlet valve 130 and similar reference numerals are used to refer to similar elements. The valve member 65 of the one-way replenishing air inlet valve 139 is constrained axially within the enlarged portion 138 of the central passageway 136 between an axial inner end of the enlarged portion 138 and an outer end wall with the locating flange 69 assisting in coaxially locating the valve member 65 in the central passageway 136. On the side of the locating flange 69 opposite from the seal disc 68, the tubular extension 71 is provided on the valve member 65 with the central passage closed at a blind end by the locating flange 69 and open at the distal end. The enlarged portion 138 of the central passageway 136 provides a radially inwardly directed surface. The valve member 65 carries the annular seal disc 68 which extends radially outwardly to engage the radially inwardly directed surface with the distal end 70 of the seal disc 68 engaging such surface in a manner to prevent fluid flow outwardly therepast when the pressure within the replenishing air chamber 125 is greater than atmospheric pressure. However, when atmospheric pressure is greater than the pressure within the replenishing air chamber 125, the seal disc 68 deflects radially inwardly to permit fluid flow therepast from the atmosphere into the replenishing air chamber 125.

Referring again to FIGS. 2 to 5, the body 12 carries a discharge air chamber casing 221 for the discharge air pump 220. The discharge air chamber casing 221 has a cylindrical wall 222 about an axis 223. The cylindrical wall 222 provides a radially inwardly directed surface 224 and defines a discharge air chamber 225 therein. The discharge air chamber 225 has a large opening 226 at an outer end 227. The piston 14 carries as part of the discharge air pump 220, a discharge air piston 231 adapted to be coaxially slidable along the axis 223 within the discharge air chamber 225. The discharge air piston 231 carries at an inner end a sealing disc 233 which is generally circular in cross-section normal the axis 223 and extends radially outwardly to a flexible distal end 234 which engages the surface 224 of the cylindrical wall 222 of the discharge air chamber casing 221 to form a seal preventing air flow inwardly or outwardly therepast. The discharge air piston 231 has a hollow stem 235 with a central passageway 236 axially therethrough from a discharge air port 237 coaxially into the mixing chamber 15 and then coaxially into the discharge outlet 13.

A discharge air compartment 261 is defined within the discharge air chamber 225 between the discharge air casing 221 and the discharge air piston 231 with a volume of the discharge air compartment 261 changing with relative axial movement of the piston 14 relative to the body 12. As is to be appreciated, in a retraction stroke, the volume of the discharge air compartment 261 decreases and pressure increases within the discharge air compartment 261 such that the discharge air pump 220 discharges air to the mixing chamber 15. In a withdrawal stroke, the volume of the discharge air compartment 261 increases creating a vacuum within the discharge air compartment 261 drawing air from the atmosphere in the discharge outlet 13 and drawing air and/or fluid in the mixing chamber 25 back towards or into discharge air chamber 225.

In the first embodiment of FIGS. 2 to 5, the axis 23 of the liquid pump 20, the axis 123 of the replenishing air pump 120 and the axis 223 of the discharge air pump 220 are each parallel. The fluid chamber casing 21 and the fluid piston 31 are substantially identical in size to the replenishing air chamber 125 and the replenishing air piston 131. The fluid compartment 61 is of substantially identical volume as the replenishing air compartment 161 in any position of the piston 14. Thus, in a cycle of operation of the pump assembly 10, with any relative length of stroke of the piston 14 relative to the body 12 in that stroke, an equal volume of fluid will effectively be withdrawn from the reservoir 11 compared to a volume of air which is discharged via the replenishing air pump 120 into the reservoir 11 towards maintaining the reservoir volume constant. The path for air moved by the replenishing air pump 120 is independent of the paths for movement of fluid by the fluid pump 20 or the discharge air pump 220.

Figure 4:
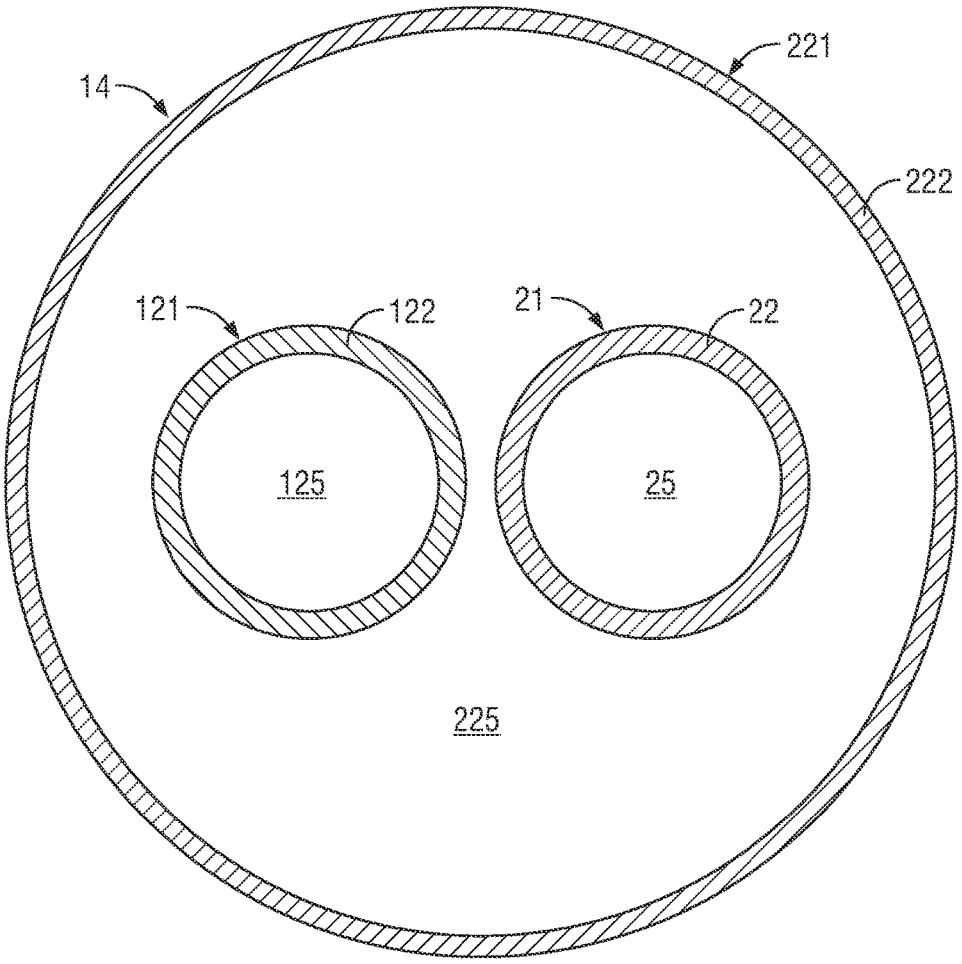
FIG. 4 is a cross sectional view through the piston chamber forming element of FIG. 1 along section line 4-4'.
Figure 5:
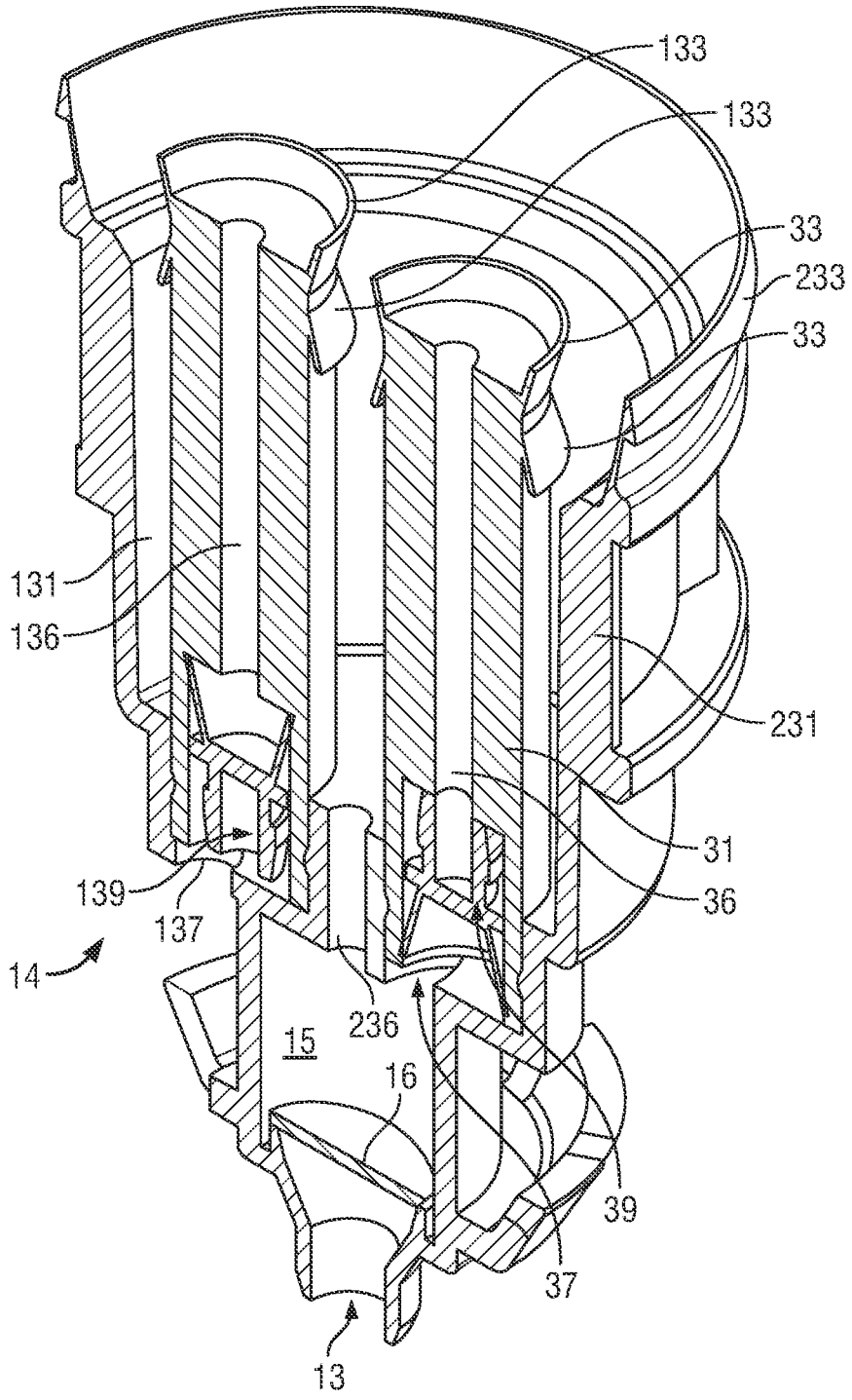
FIG. 5 is a perspective view of the cross-sectioned piston as shown in FIG. 2.
Figure 6:
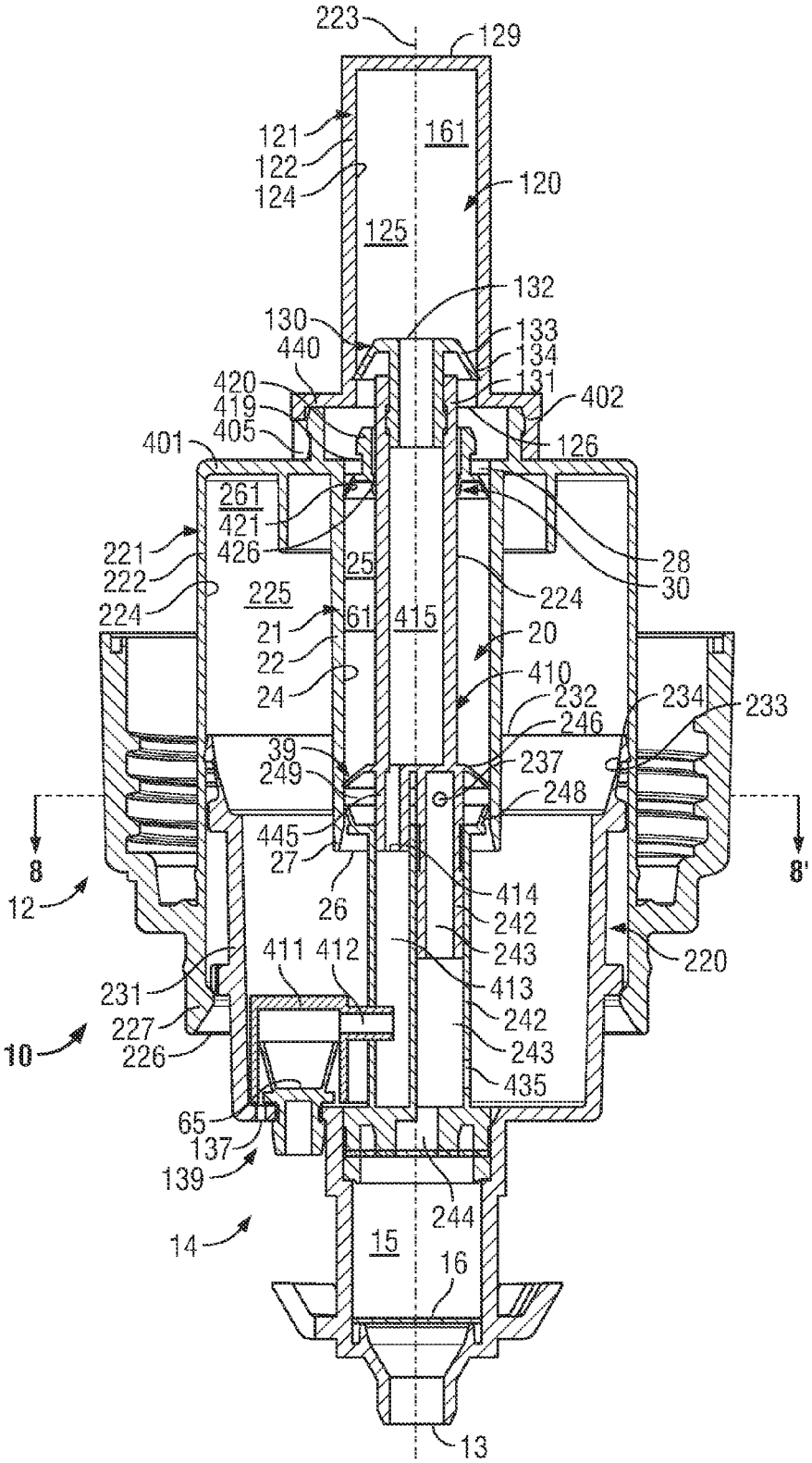
FIG. 6 is a cross-sectional side view of an assembled pump assembly of a second embodiment of a pump assembly in accordance with the present invention with the piston in an extended position.
Figure 7:
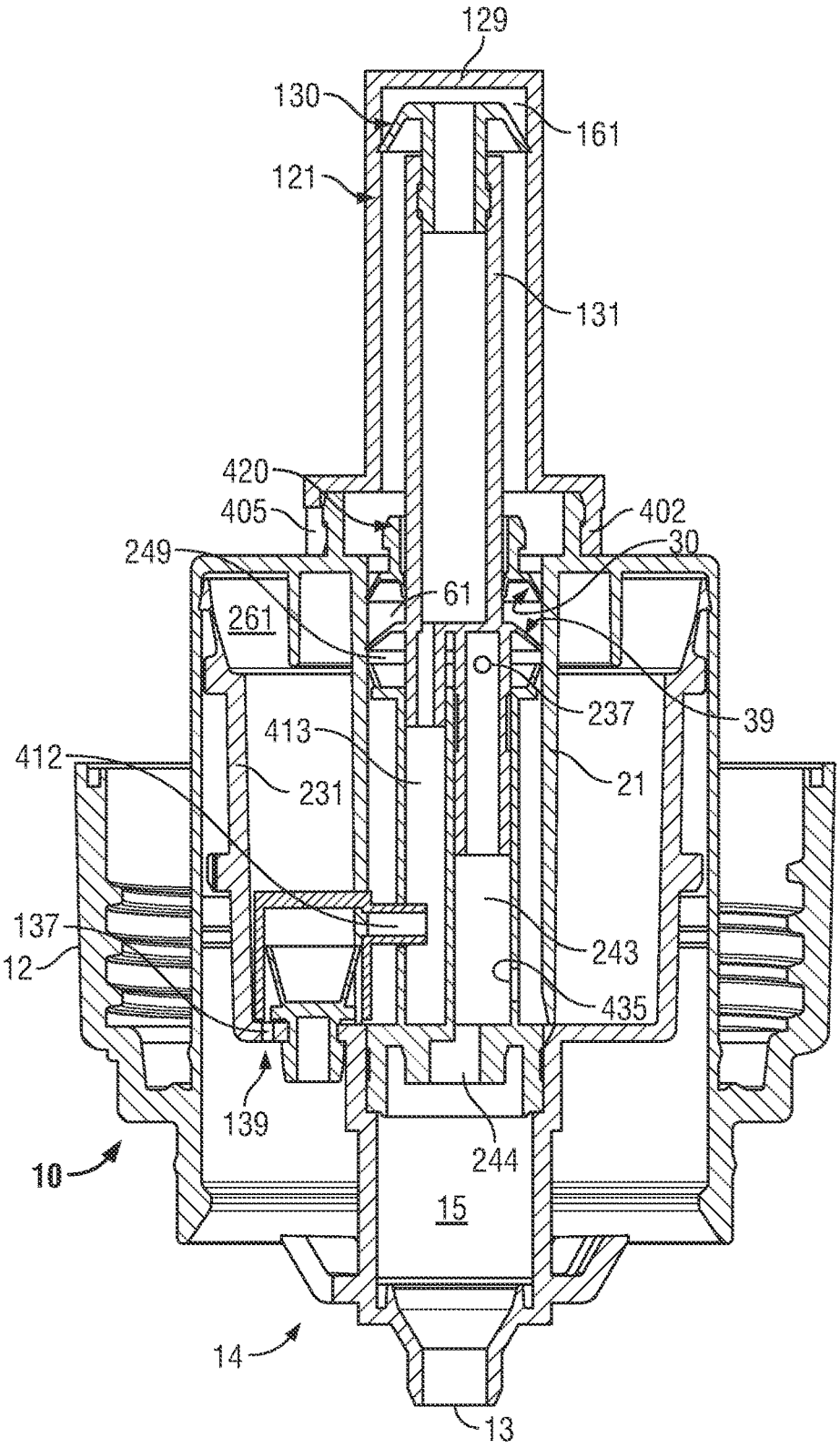
FIG. 7 is a cross-sectional side view of the pump assembly of FIG. 6 with the piston in a fully retracted position.

As best can be seen in FIGS. 4 and 5, the fluid chamber casing 21 and the replenishing air chamber casing 121 extend parallel to each other as cylindrical tubes located within the discharge air chamber casing 221 which extends circumferentially about both the fluid chamber casing 21 and the replenishing air chamber casing 121.

Reference is now made to FIG. 1 which schematically shows one embodiment of a dispenser 370 utilizing a removable refill cartridge 369 comprising the piston pump assembly 10 and the container or reservoir 11. The pump assembly 10 has the two principle components, namely, the piston chamber-forming member or body 12 and the piston-forming element or piston 14. The pump assembly 10 and reservoir 11 are secured together with the body 12 secured in a neck 371 of the reservoir 11. The piston 14 is slidably received within a chamber (not shown) formed within the body 12 such that reciprocal sliding of the piston 14 relative to the body 12 dispenses material from the discharge outlet 13 of the piston 14.

Referring again to FIG. 1, dispenser 370 has a housing generally indicated 372 to receive and support the pump assembly 10 and reservoir 11. Housing 372 is shown with a back plate 373 for mounting the housing, for example, to a building wall 374. A bottom support plate 375 extends forwardly from the back plate to receive and support the reservoir 11 and pump assembly 10. As shown, bottom support plate 375 has a circular opening 376 therethrough. The reservoir 11 sits supported on plate 375 with its neck 371 extending through opening 376 and secured in the opening as by friction fit, clamping and the like. A cover member 377 is hinged to an upper forward extension 378 of back plate 373 so as to permit replacement of reservoir 11 and its pump assembly 10.

The cover member 377 has a window 379 therethrough via which the reservoir 11 is visible as, for example, for a person to see the level of fluid within the reservoir 11.

The support plate 375 carries at a forward portion thereof an actuating lever 380 journalled for pivoting about a horizontal axis 381. An upper end of lever 380 carries a hook 382 to engage an engagement flange 383 on the piston 14 and couple lever 380 to piston 14 such that movement of a lower handle end 384 of lever 380 from the dashed to the solid line position in the direction indicated by the arrow 385 slides piston 14 inwardly in a retraction, pumping stroke as indicated by arrow 386. On release of lower handle end 384, a spring 387 biases the upper portion of lever 380 downwardly so that the lever 380 draws piston 14 outwardly to a fully withdrawn position as seen in the dashed lines in FIG. 1. Lever 380 and its hook 382 are adapted to permit manual coupling and uncoupling of the hook 382 as is necessary to remove and replace the replaceable cartridge 364 comprising the reservoir 11 and pump assembly 10.

In use of the dispenser 370, once exhausted, the cartridge 369 with the empty reservoir 11 together with its attached pump 10 are removed and a new cartridge 369 having a new reservoir 11 and attached pump 10 are inserted into the housing 372.

FIG. 1 schematically shows one embodiment of a dispenser 370 which is adapted for use with a pump assembly 10 in accordance with the present invention. However, the invention is not limited to the use of a dispenser having a configuration as shown in FIG. 1. Many other forms of dispensers may be used. In the dispenser of FIG. 1, the reservoir 11 is contained within the cover 377 and the window 379 is provided through the cover 379 to see the reservoir 11. An embodiment of a dispenser in which the reservoir is covered by a cover with a window through the cover may be seen in U.S. Pat. No. D568,659 to Ophardt, issued May 13, 2008.

The provision of the window 379 is not necessary in accordance with the present invention. The reservoir 11 may be provided and enclosed within a cover against view.

In other dispensers useful with the present invention, the reservoir 11 may be visible to view as, for example, shown in U.S. Pat. No. 8,622,243 to Ophardt, issued Jan. 7, 2014, showing an automatically operated touchless dispenser and in U.S. Pat. No. 7,748,574 to Ophardt, issued Jul. 6, 2010, showing a reservoir which is visible in use on a manually operated dispenser. Such a visible reservoir in a manually operated dispenser may also be seen in U.S. Pat. No. D530,123 to Ophardt, issued Oct. 17, 2006.

The pump assembly 10 in accordance with the present invention may be used with other dispensers and those described or referred herein. The dispensers may be adapted for dispensing material in any direction whether upwardly or downwardly or horizontally and from reservoirs which may be disposed at any orientation.

Reference is made to FIGS. 6 to 9 which show a pump assembly 10 in accordance with a second embodiment of the present invention. The components and operation of the pump assembly 10 in accordance with a second embodiment has many similarities to the first embodiment of the pump assembly 10 with similar reference numerals used to refer to many similar elements. The pump assembly 10 comprises two principal components, namely, a body 12 and a piston 14. The pump assembly provides three pumps, namely, a fluid pump 20, a replenishing air pump 120 and a discharge air pump 220.

The body 12 provides a discharge air casing 221 with a cylindrical wall 222 about an axis 223. The cylindrical wall provides an inwardly directed surface 224 and defines a discharge air chamber 225 therein. The discharge air chamber 225 has a large opening 226 at an outer end 227. The wall 222 of the discharge air casing 221 merges into an annular end shoulder 401. Extending axially outwardly from the annular end shoulder 401 is the fluid chamber casing 21 as a hollow tube having a cylindrical wall 22 about the axis 223. The cylindrical wall 222 provides a radially inwardly directed surface 224 and defines a fluid chamber 25 therein. The fluid chamber has a large opening 26 at an outer end 27, a fluid inlet 28 at an inner end, a one-way inlet valve 30 is disposed across the fluid inlet between fluid chamber 25 and the reservoir 11.

Extending axially inwardly from the end shoulder 401 is a passage tube 402 which ends at an inner annular shoulder 440 carrying at its center an axially inwardly extending replenishing air chamber casing 121 with a cylindrical wall 122 about the center axis 223. The replenishing air chamber casing 121 is closed at its inner end 129. The passage tube 402 has a plurality of passage ports 405 extending radially therethrough at circumferentially spaced locations although only one passage port 405 is shown. A replenishing air chamber 125 is defined within the replenishing air chamber casing 121 with a large opening 126 at the outer end opening into the passage tube 402. The piston 14 carries as part of the replenishing air pump 120 a replenishing air piston 131 adapted to be coaxially slidable within the replenishing air chamber 125. The replenishing air piston 131 carries at its inner end 132 a sealing disc 133 which is generally circular in cross-section normal to the axis and extends radially outwardly to a flexible distal end 134 which engages a radially inner surface 124 of the cylindrical wall 122 of the replenishing air chamber casing 121 to form a seal preventing flow inwardly therepast. The sealing disc 133 interacts with the replenishing air chamber casing 121 to form as a one-way replenishing air outlet valve 130. When the pressure on the axial inward side of the sealing disc 133 is greater than the pressure on the axial outward side, then the sealing disc 133 has its flexible distal end 134 deflect inwardly away from the surface 134 of the cylindrical wall 122 of the replenishing air casing 121 such that air may be discharged into the passage tube 402 and hence via the passage ports 405 into the reservoir 11.

The replenishing air pump 120 includes a one-way replenishing air inlet valve 139 carried on the piston 14 across a replenishing air inlet 137 on the piston 14. The replenishing air inlet 137 is in communication with the replenishing air chamber 125 internally through a hollow stem 410 of the piston 12 via a cylindrical compartment 411 containing a one-way valve member 65, a radial passageway 412 and axially extending passageways 413, 414 and 415 within the stem 410. The passageway 415 extends axially coaxially through the sealing disc 133 and opens at the inner end 132 into the replenishing air chamber 125. A replenishing air compartment 161 is defined in between the one-way replenishing air inlet valve 130 and the one-way replenishing air outlet valve 139 within the replenishing air chamber 125 between the replenishing air casing 121 and the replenishing air piston 131 and including the compartment 411 and passageways 412, 413, 414 and 415. In a retraction stroke, the volume of the replenishing air compartment 161 decreases and pressure increases to close the one-way replenishing air inlet valve 139 and open the one-way replenishing outlet valve 130 such that air is discharged into the reservoir 11. In a withdrawal stroke, the volume of the replenishing air compartment 160 increases creating a vacuum within replenishing air compartment 161 which closes the one-way replenishing air outlet valve 130 formed by the sealing disc 133 and opens the one-way replenishing air inlet valve 139 drawing air from the atmosphere through the replenishing air inlet 137 into the replenishing air chamber 125.

At the inner end of the fluid chamber, the end shoulder 401 extends radially inwardly as a locating shoulder 419. A seal member 420 is engaged on the shoulder 419 by the shoulder being received within an annular slot of the seal member 420. The seal member 420 has an annular sealing disc 421 which extends radially outwardly to a distal end which engages the cylindrical wall 22 of the fluid chamber casing 21 in a manner to prevent fluid flow inwardly therepast. The sealing disc 421 forms with the fluid chamber casing 21 the one-way fluid inlet valve 30.

The stem 410 of the piston 14 includes a cylindrical portion 224 with a cylindrical outer surface which in operation is disposed radially inwardly of the seal member 420. The seal member 420 has an annular opening centrally therethrough. A sealing disc 426 extends radially inwardly from the seal member 420 to engage the cylindrical portion 220 and provide a fluid seal preventing fluid flow axially inwardly therebetween yet permit axial sliding of the cylindrical portion 224 relative to the seal member 420.

The stem 410 carries a sealing disc 246 at an outer end of the cylindrical portion 224 which sealing disc 246 extends radially outwardly to a distal end which engages the cylindrical wall 22 of the fluid chamber casing 21. This distal end engages the surface 24 of the cylindrical wall 22 to form a seal preventing fluid flow inwardly therepast yet, under certain conditions, permits fluid flow outwardly therepast. The seal disc 426 thus with the fluid chamber casing 21 forms a one-way fluid outlet valve 39.

On the stem 410 outwardly from the seal disc 246, a seal disc 248 is provided which extends radially outwardly and axially inwardly to a flexible distal end which engages the surface 24 of the cylindrical wall 22 of the fluid chamber casing 21 to form a seal preventing flow outwardly and inwardly therepast. An annular transfer chamber 249 is defined about the stem 421 axially between the seal disc 246 and the seal disc 248. A transfer tube 242 extends axially from a closed inner end through the annular transfer chamber 249. A transfer port 237 extends radially through a wall of the transfer tube 242 within the annular transfer chamber 249. The transfer port 237 provides for fluid flow from the annular transfer chamber 249 into the transfer tube 242. The transfer tube 242 provides passages 243 opening outward to the mixing chamber 15. The annular transfer chamber 249 is always open to the atmosphere via the transfer port 237, the passages 243, the mixing chamber 15, the screen 16 and a discharge outlet 13.

A fluid compartment 61 is defined within the fluid chamber 25 between the fluid casing 21 and the fluid piston 31 between the one-way fluid inlet valve 30 and the one-way fluid outlet valve 39. In a refraction stroke, the volume of the fluid compartment 61 decreases and pressure within the fluid compartment 61 increases which closes the one-way fluid inlet valve 30 and opens the one-way fluid outlet valve 39 such that the fluid pump 20 discharges fluid into the annular transfer chamber 249 and via the transfer port 237 and passages 243 and 244 to the mixing chamber 15 and hence to the discharge outlet 13. In a withdrawal stroke, a volume of the fluid compartment 61 increases creating a vacuum within the fluid compartment 61 which closes the one-way fluid outlet valve 39 and opens the one-way fluid inlet valve 30 drawing fluid from the reservoir 11 through the fluid inlet 28 into the fluid chamber 25. During operation of the fluid pump 20, fluid from the reservoir 11 is drawn inwardly through the passage ports 405 into the passage tube 402 and hence to the seal member 420 carrying the one-way fluid inlet valve 30. The piston 14 carries as part of the discharge air pump 220, a discharge air piston 231 adapted to be coaxially slidable along the axis 223 within the discharge air chamber 225. The discharge air piston 231 carries at an inner end 232 a sealing disc 233 which is generally circular in cross-section normal the axis 223 and extends radially outwardly to a flexible distal end 234 which engages the surface 224 of the cylindrical wall 222 of the discharge air chamber casing 221 to form a seal preventing air flow inwardly or outwardly therepast. A discharge port 435 is provided through the transfer tube 242.

A discharge air chamber 261 is defined within the discharge air chamber 225 between the discharge air casing 221 and the discharge air piston 231. In a retraction stroke, the volume of the discharge air compartment 261 decreases and pressure increases within the discharge air compartment 261 discharging air via the discharge port 435 to passages 243 and 244 to the mixing chamber 15. In a withdrawal stroke, the discharge air chamber 261 increases creating a vacuum within a discharge air compartment 261 drawing air from the atmosphere in via the discharge outlet 13 and drawing air and/or fluid in the mixing chamber 15 back towards or into the discharge air chamber 225 via the passages 242 and 243 and discharge port 435.

Figure 8:
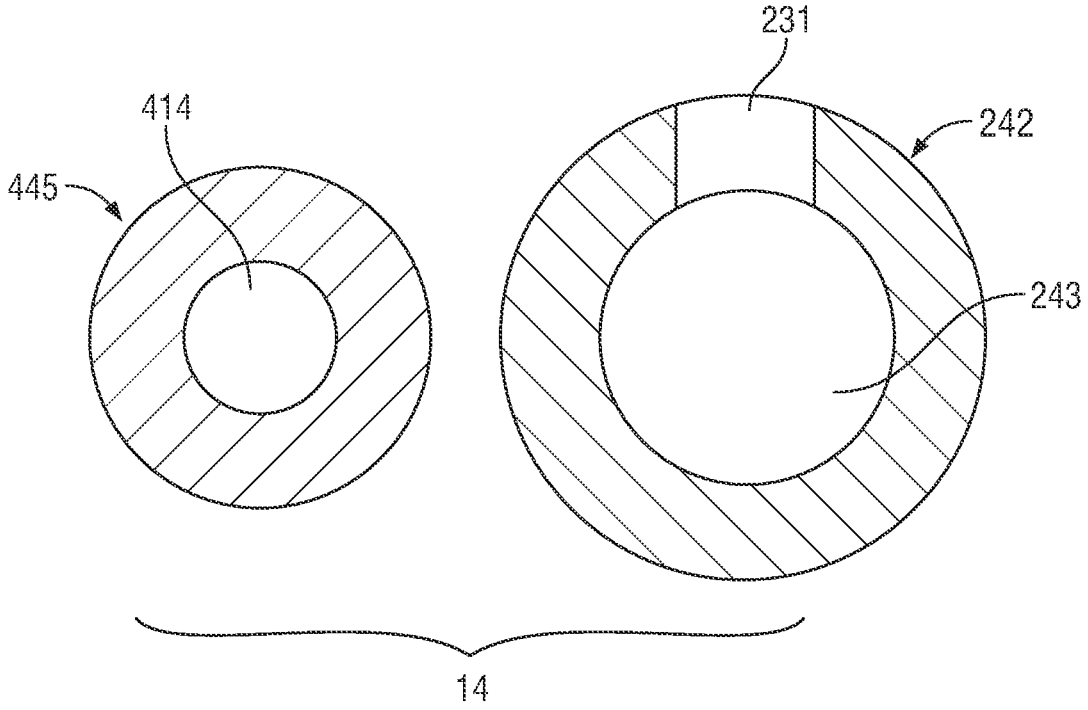
FIG. 8 is a cross-sectional view through the piston of FIG. 6 along section line 8-8'.
Figure 9:
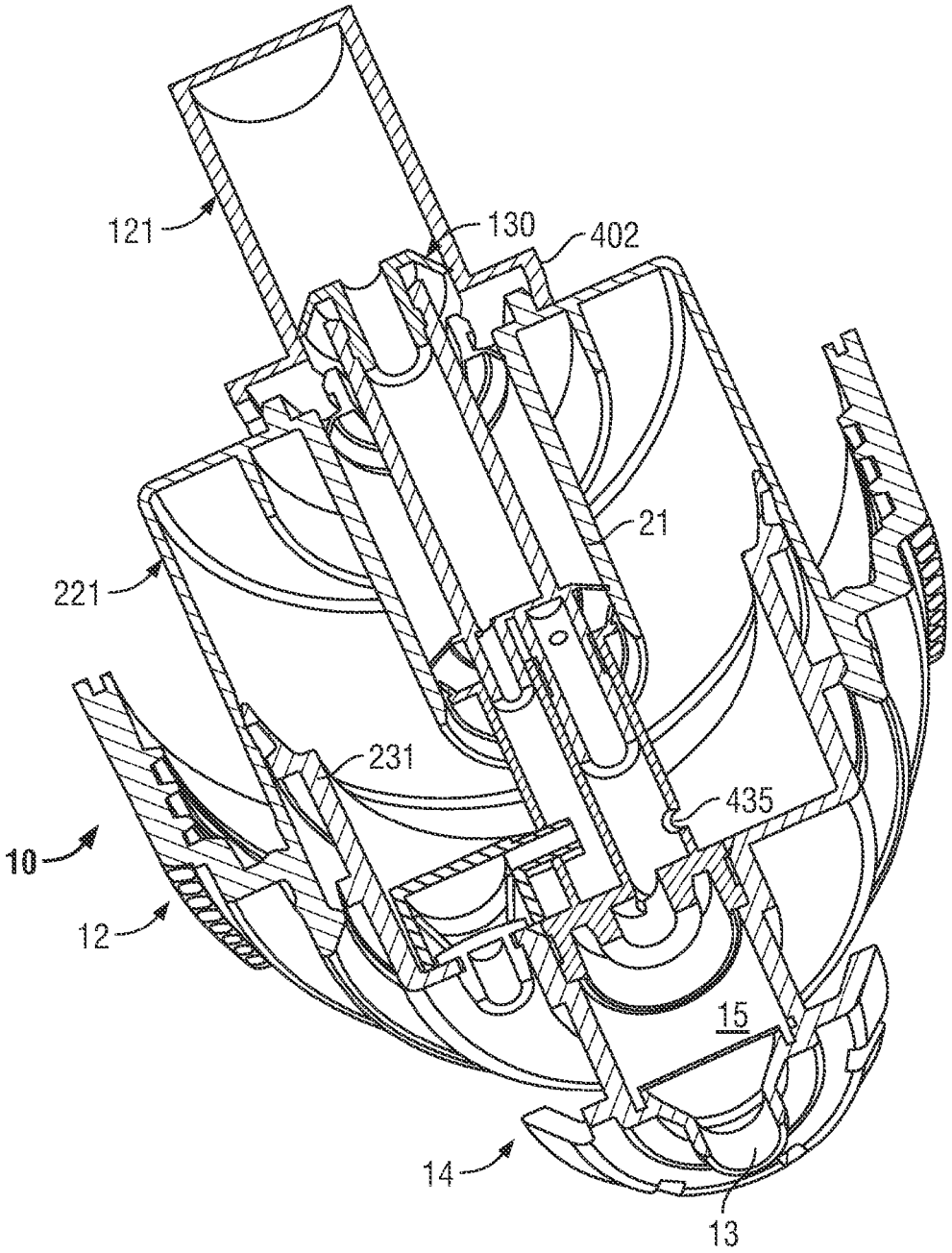
FIG. 9 is a perspective view of the cross-sectioned pump assembly as shown in FIG. 6.

The second embodiment operates in substantially the same manner as the first embodiment. Within the stem 410 between the seal disc 246 and the mixing chamber 15, the stem 410 accommodates separate axial passages for, on one hand, the transfer of air via the passage 414 by the replenishing air pump 120 and, on the other hand, for transfer of fluid via the passage 243 by the fluid pump 20. The passage 414 is inside a tube 445 passing through the annular transfer chamber 249 beside the parallel passage 243 through the tube 242 as seen in FIG. 8 in cross-section.

Figure 10:
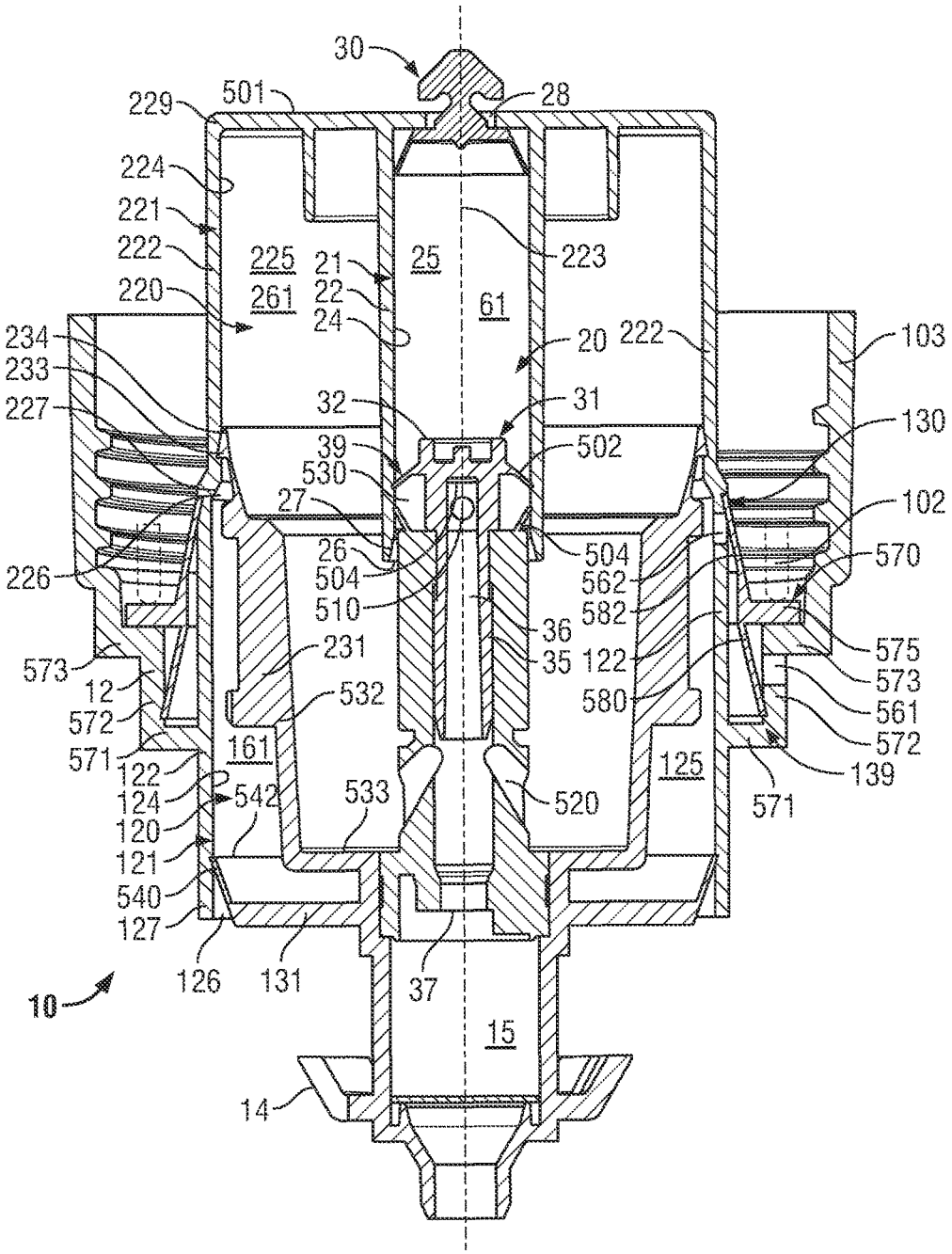
FIG. 10 is a cross-sectional side view of an assembled pump assembly of a third embodiment of a pump assembly in accordance with the present invention with the piston in an extended position.
Figure 11:
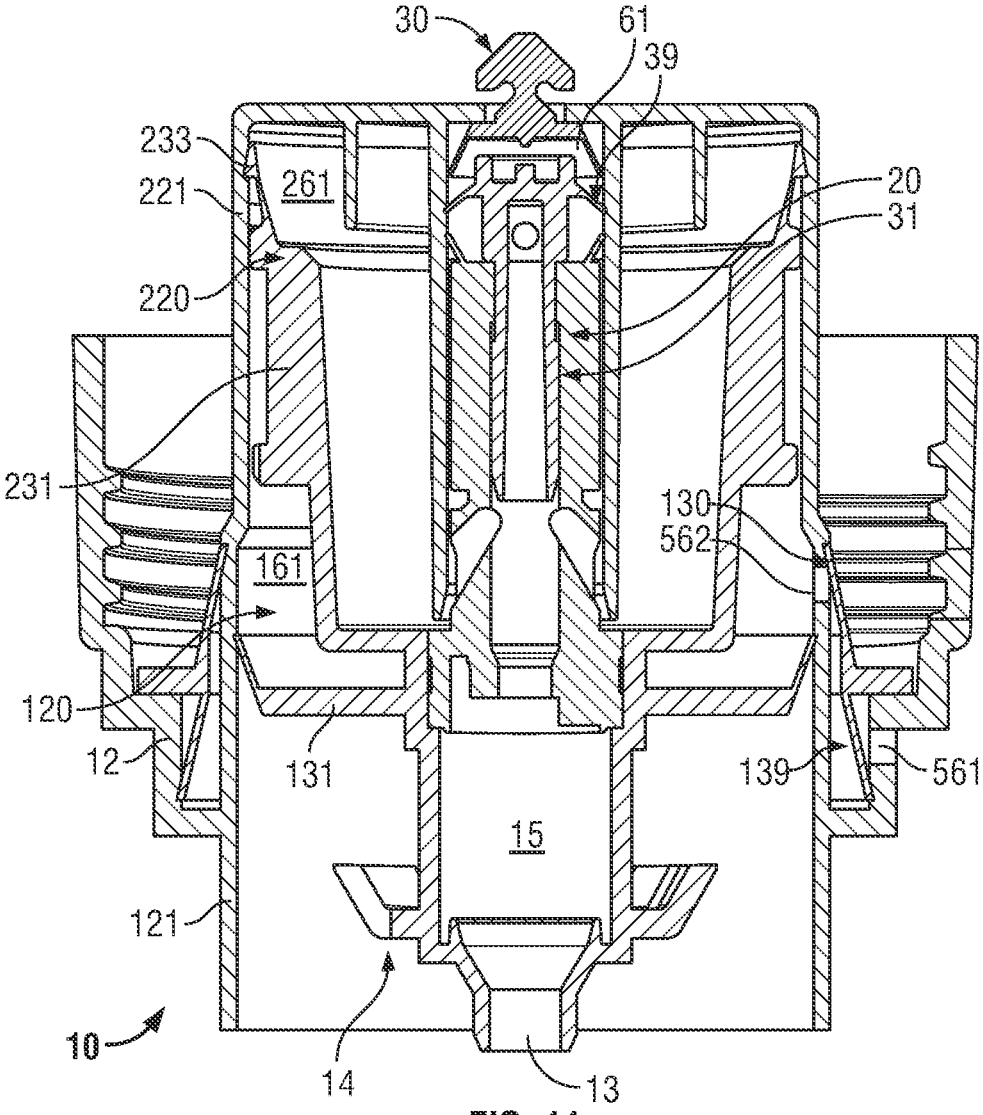
FIG. 11 is a cross-sectional side view of the pump assembly of FIG. 10 with the piston in a fully retracted position.
Figure 12:
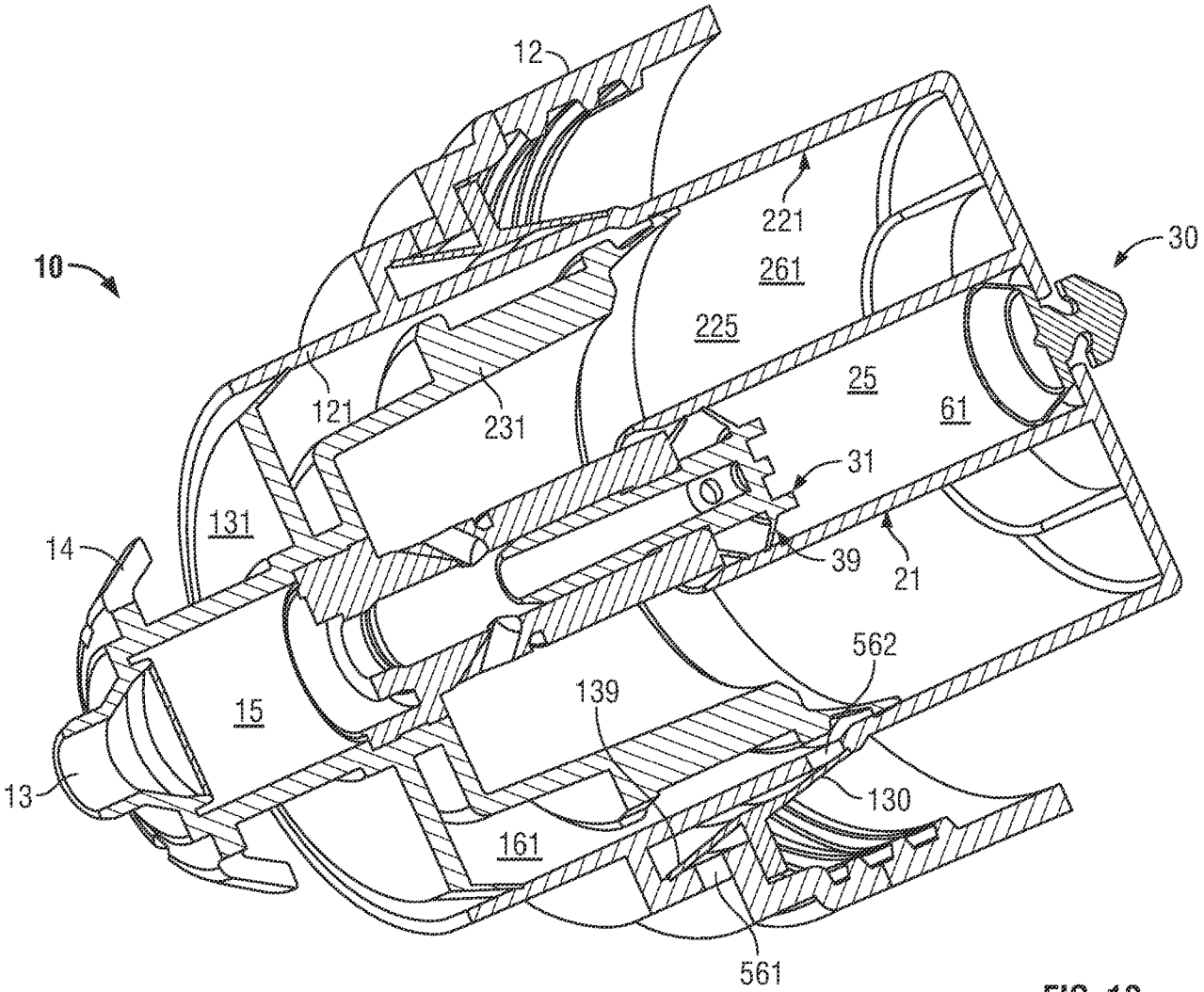
FIG. 12 is a perspective view of the cross-sectioned pump assembly as shown in FIG. 11.

Reference is made to FIGS. 10 to 12 which show a pump assembly 10 in accordance with a third embodiment of the present invention. The pump assembly 10 of the third embodiment has substantial similarities to the pump assembly 10 of the first embodiment and similar reference numerals are used to refer to similar elements. The pump assembly 10 includes a body 12 and piston 14. In this third embodiment, substantially all of the elements are disposed coaxially about a center axis 223. The pump assembly 10 provides three pumps, namely, a liquid pump 20, a replenishing air pump 120 and a discharge air pump 220.

The body 12 carries a discharge air chamber casing 221 having a cylindrical wall 222 about the axis 223. The cylindrical wall 222 provides a radially inwardly directed surface 224 and defines a discharge air chamber 225 therein. The discharge air chamber 225 has a large opening 226 at an outer end 227. The body 12 has an end wall 501 closing the inner end 229 of the cylindrical wall 220. A fluid chamber casing 21 is carried by the end wall 501 and extends outwardly thereof as a tube with a cylindrical wall 22 about the axis 223. The cylindrical wall provides a radially inwardly directed surface 24 and defines a fluid chamber 25 therein. The fluid chamber has an opening 26 at an outer end 27 and a fluid inlet 28 at an inner end through the end wall 501. A one-way fluid inlet valve 30 is disposed across the fluid inlet between the fluid chamber 25 and the reservoir 11.

Piston 14 carries a fluid piston 31 coaxially slidable along the axis 223 within the fluid chamber 25. The piston 14 carries at an inner end a sealing disc 502 which is generally circular in cross-section normal the axis 223 and extends radially outwardly and axially outwardly to a flexible distal end which engages the surface 24 of the cylindrical wall 22 to form a seal preventing fluid flow inwardly therepast but under certain conditions permitting fluid flow inwardly. The sealing disc 502 effectively forms with the wall 22 a one-way fluid outlet valve 39. The fluid piston 31 has a hollow stem 35 with a central passageway 36 axially therethrough from a blind end 504 proximate the inner end 32 through the fluid piston 31 to a fluid outlet 37 opening into the mixing chamber 15. On the stem 35 outwardly from the seal disc 502, an annular sealing disc 504 extends radially outwardly and axially inwardly to a flexible distal end which engages the surface 24 of the cylindrical wall 22 of the fluid chamber casing 21 to form a seal preventing fluid flow outwardly therepast. An annular transfer chamber 530 is provided annularly about the stem 35 inside the cylindrical wall 22 between the seal disc 502 and the seal disc 504. A transfer port 510 is provided through the wall of the stem 35 to provide flow between the annular transfer chamber 530 and the central passageway 36. A fluid compartment 61 is defined within the fluid chamber 25 between the fluid casing 21 in between the one-way fluid inlet valve 30 and the one-way outlet valve 39. In a retraction stroke, the volume of the fluid compartment 61 decreases and the pressure within the fluid compartment increases which closes the one-way fluid inlet valve 30 and opens the one-way fluid outlet valve 39 such that the fluid pump discharges fluid to the mixing chamber via the transfer chamber 530, transfer port 510 and central passageway 36. In a withdrawal stroke, volume of the fluid compartment 61 increases creating a vacuum in the fluid compartment 61 which closes the one-way fluid outlet valve 39 and opens the one-way fluid valve 30 drawing fluid from the reservoir 11 through the fluid inlet 28 into the fluid chamber 25.

The stem 35 also includes outwardly from the seal disc 504, air passage ports 520 providing communication into the central passageway 36. Piston 14 carries a part of the discharge air pump 220 a discharge air piston 231 adapted to be coaxially slidable along the axis 223 within the discharge air chamber 225. The discharge air piston 231 carries at an inner end 232 a sealing disc 233 which extends radially outwardly to a flexible distal end 234 which engages the surface 224 of the cylindrical wall 222 of the discharge air chamber casing 221 to form a seal preventing air flow inwardly or outwardly therepast. A discharge air compartment 261 is defined within the discharge air chamber 225 between the discharge air casing 221 and the discharge air piston 231. In a retraction stroke, the volume of the discharge air compartment 261 decreases and pressure increases within discharge air compartment 261 such that air is discharged via the port 520 into the central passageway 36 and out to the mixing chamber 15. In a withdrawal stroke, the volume of the discharge air compartment 261 increases creating a vacuum within the discharge air compartment 261 which via the air passage ports 520 and central passageway 36 draws air from the atmosphere via the discharge outlet 13 and draws air and/or fluid in the mixing chamber 25 back towards or into the discharge air chamber 225.

The discharge air piston 231 has the sealing disc 223 at an inner end 232 and extends axially outwardly as a generally axially extending cup side wall 532 ending in an annular cup end wall 533 which joins to the stem 35 of the piston 14 below the air passage ports 520. The discharge air casing 221 has its cylindrical wall 222 end at an outer end 227 which merges axially outwardly into cylindrical wall 122 also about the axis 223 which forms the replenishing air casing 121 providing a replenishing air chamber 125 therewithin. The cylindrical wall 122 extends outwardly to an opening 126 at an outer end 127. The cylindrical wall provides a radially inwardly directed surface 124. The piston 14 carries as part of the replenishing air pump 120, a replenishing air piston 131 comprising an annular sealing disc 540 extending radially outwardly on the stem 35 outwardly of the cup end wall 533, the sealing disc 540 is generally circular in cross-section normal the axis 223 and extends radially outwardly to a flexible distal end 542 which engages the surface 124 of the cylindrical wall 122 to form a seal preventing air flow at least outwardly therepast.

An annular replenishing air compartment 161 is defined radially inwardly of the cylindrical walls 122 and 222 and radially outwardly of the piston member 14 between the replenishing air sealing disc 540 and the discharge air sealing disc 233. As seen in FIGS. 10 and 11, the cylindrical wall 122 has a diameter larger than the diameter of the cylindrical wall 222. Thus, as seen on FIGS. 10 and 11, the cylindrical walls 122 and 222 define the replenishing air chamber 116 as a stepped diameter chamber. The replenishing air chamber 116, as seen on FIGS. 10 and 11, has an inner chamber portion within the cylindrical wall 222 that is open axially into an outer chamber portion within the cylindrical wall 122 of the annular replenishing air compartment 116. As seen in FIGS. 10 and 11, on moving from the extended position of FIG. 10 to the retracted position of FIG. 11, the volume of the annular replenishing air compartment 116 decreases and, in moving from the retracted position of FIG. 11 to the withdrawn position of FIG. 10, the volume of the annular replenishing air compartment 116 increases.

From the cylindrical wall 122, a first annular flange 571 extends radially outwardly to a first cylindrical tube 572 which extends axially inwardly to merge into a second annular flange 573 which extends radially outwardly and merges with an axially inwardly extending collar 103 carrying threads on its interior. A first port 561 is provided through the first cylindrical portion 572 open to the atmosphere. A second port 562 is provided through the wall 122 inwardly of the first port 561.

A resilient valving member 570 is disposed within the annular space formed between the cylindrical walls 122 and 222 and the collar 103, the second cylindrical flange 573, the first cylindrical portion 572 and the first annular flange 571. The valving member 570 carries an annular radially extending support ring 575 which sits on the second annular flange 573 and is secured therein against axial movement as when a threaded neck 102 of a reservoir 11 is threaded into the collar 103 to engage and hold the support ring 575 sandwiched between an axial end of the neck 102 of the reservoir 11 and the second annular flange 573 forming an annular seal with the second annular flange 573 which prevents fluid flow axially or radially therepast. In FIG. 10, the axial end of the neck 102 is shown in dashed lines.

The valving member 570 includes an outer seal disc 580 which extends radially outwardly and axially outwardly to a distal end which engages a radially inwardly directed wall of the first cylindrical portion 571 to form a seal therewith which prevents air flow radially outwardly through the first port 561 yet permits air flow inwardly through the first port 561 under certain conditions. The valving member 570 has an inner seal disc 582 which extends radially inwardly and axially inwardly to engage a radially outwardly directed surface of the cylindrical wall 122 axially inwardly of the second port 562. The inner seal disc 582 has a distal end which engages the wall 22 to prevent air flow from the second port 562 to the reservoir 11 radially outwardly and axially inwardly past the seal disc 582 and, under certain conditions, deflects to permit flow inwardly into the reservoir 11. The inner seal disc 582 effectively forms a one-way replenishing air outlet valve 130 and the outer sealing disc 580 effectively forms a one-way replenishing air inlet valve 139. In a retraction stroke, the volume of the replenishing air compartment 161 decreases and pressure increases within the replenishing air compartment 161 which closes the one-way replenishing air inlet valve 139 and opens the one-way replenishing air outlet valve 130 such that air discharges into the reservoir 11. In a withdrawal stroke, the volume of the replenishing air compartment 161 increases creating a vacuum within the replenishing air compartment 161 which closes the one-way replenishing air outlet valve 130 and opens the one-way replenishing air inlet valve 139 drawing air from the atmosphere through the replenishing air inlet port 560 into the replenishing air chamber 125.

Figure 13:
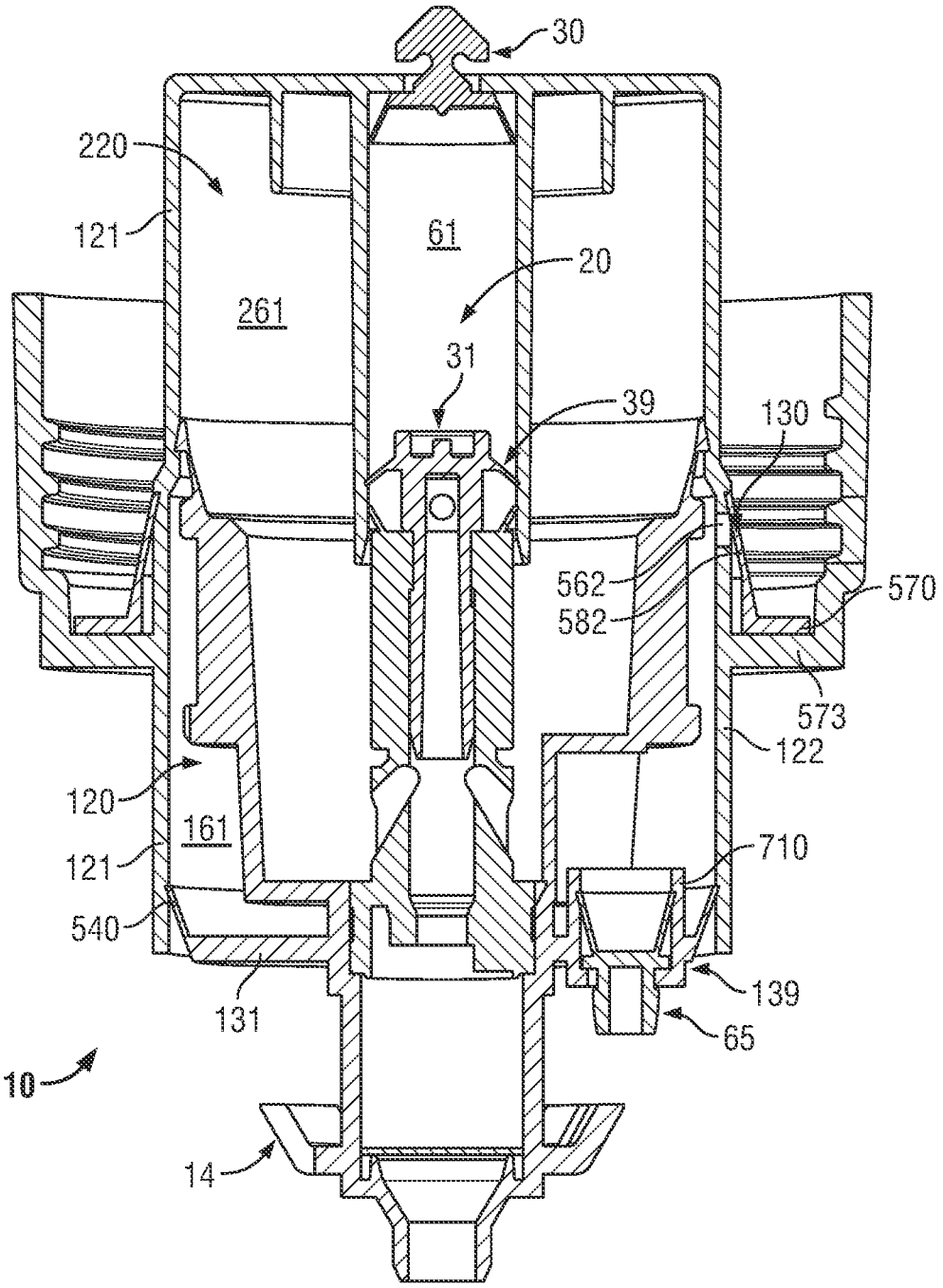
FIG. 13 is a cross-sectional side view of an assembled pump assembly of a fourth embodiment of a pump assembly in accordance with the present invention with the piston in an extended position.

Reference is made to FIG. 13 which shows a pump assembly 10 in accordance with a fourth embodiment of the present invention. The pump assembly 10 of the fourth embodiment is substantially identical to the pump assembly 10 of the third embodiment with the following noted exceptions:

(a) on the body 12, the first annular flange 571 and the first cylinder 572 of the third embodiment have been eliminated such that in the fourth embodiment, the second annular flange 573 is directly coupled to the cylindrical wall 122 with the first port 561 eliminated;

(b) the valving member 570 has been amended to eliminate the outer seal disc 580;

(c) the piston 14 has been amended to provide a one-way replenishing air inlet valve 139 with a valve member 65 in a tubular axially extending port 710 through the air replenishing disc 131.

Figure 14:
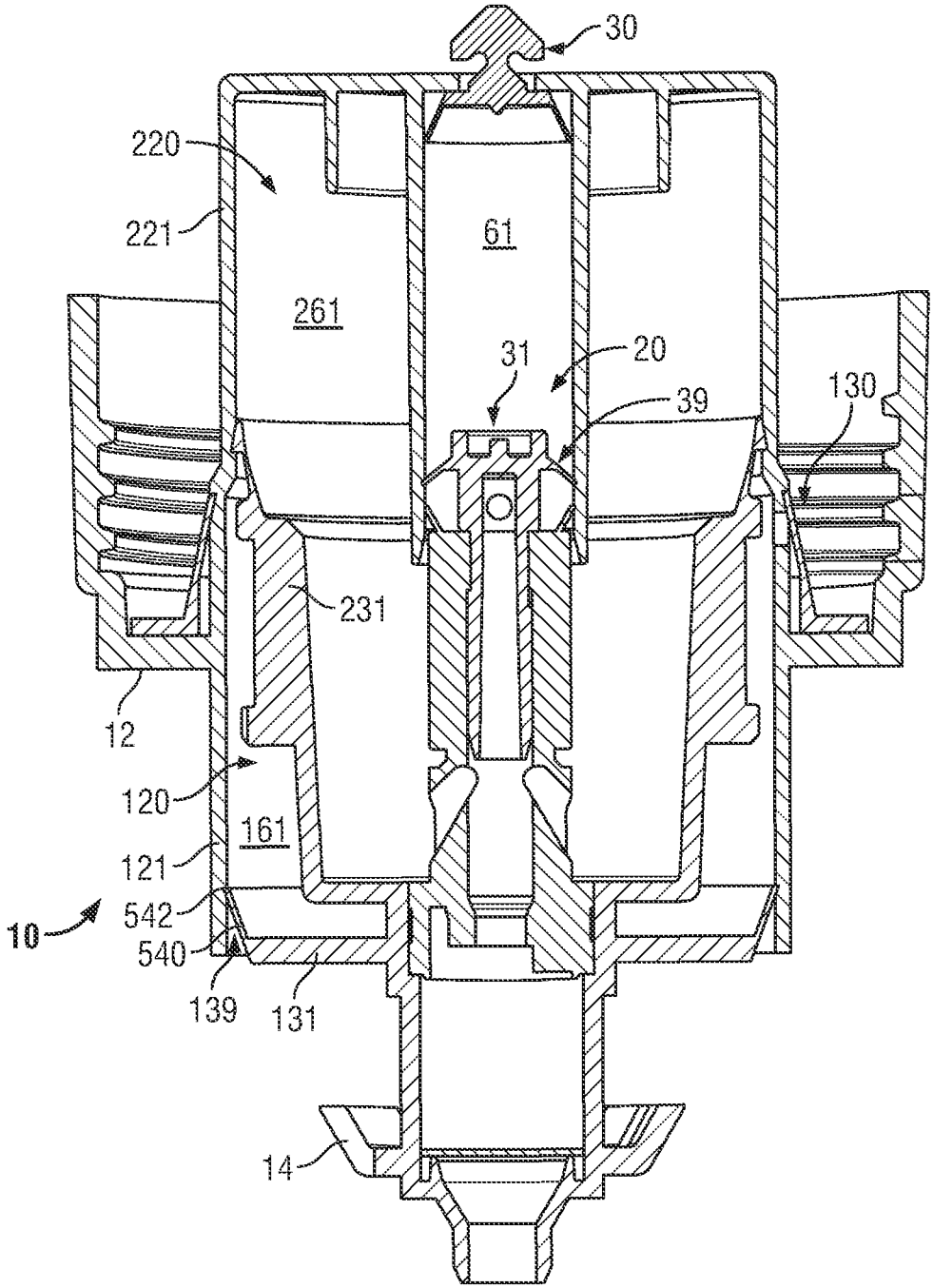
FIG. 14 is a cross-sectional side view of an assembled pump assembly of a fifth embodiment of a pump assembly in accordance with the present invention with the piston in an extended position.

Reference is made to FIG. 14 which shows a pump assembly 10 in accordance with a fifth embodiment of the present invention. The pump assembly 10 shown in FIG. 14 is identical to the embodiment shown in FIG. 13 with the exception that the port 71 and valve member 65 have been eliminated. In the embodiment of FIG. 14, the sealing disc 540 which is carried by the replenishing air piston 131 has its outer distal end 542 engage the wall 122 with a resiliency which prevents fluid flow outwardly, however, under vacuum conditions in the replenishing air compartment 161 deflects to permit atmospheric air to flow inwardly therepast into the replenishing air compartment 161. Thus, the sealing disc 540 serves as a one-way air replenishing inlet valve 139.

Each of the embodiments illustrated in FIGS. 10 to 14 have the advantage that the replenishing air compartment 161 is provided annularly outwardly of the discharge air compartment 261 yet without significantly reducing the volume of the discharge air compartment 261.

Figure 15:
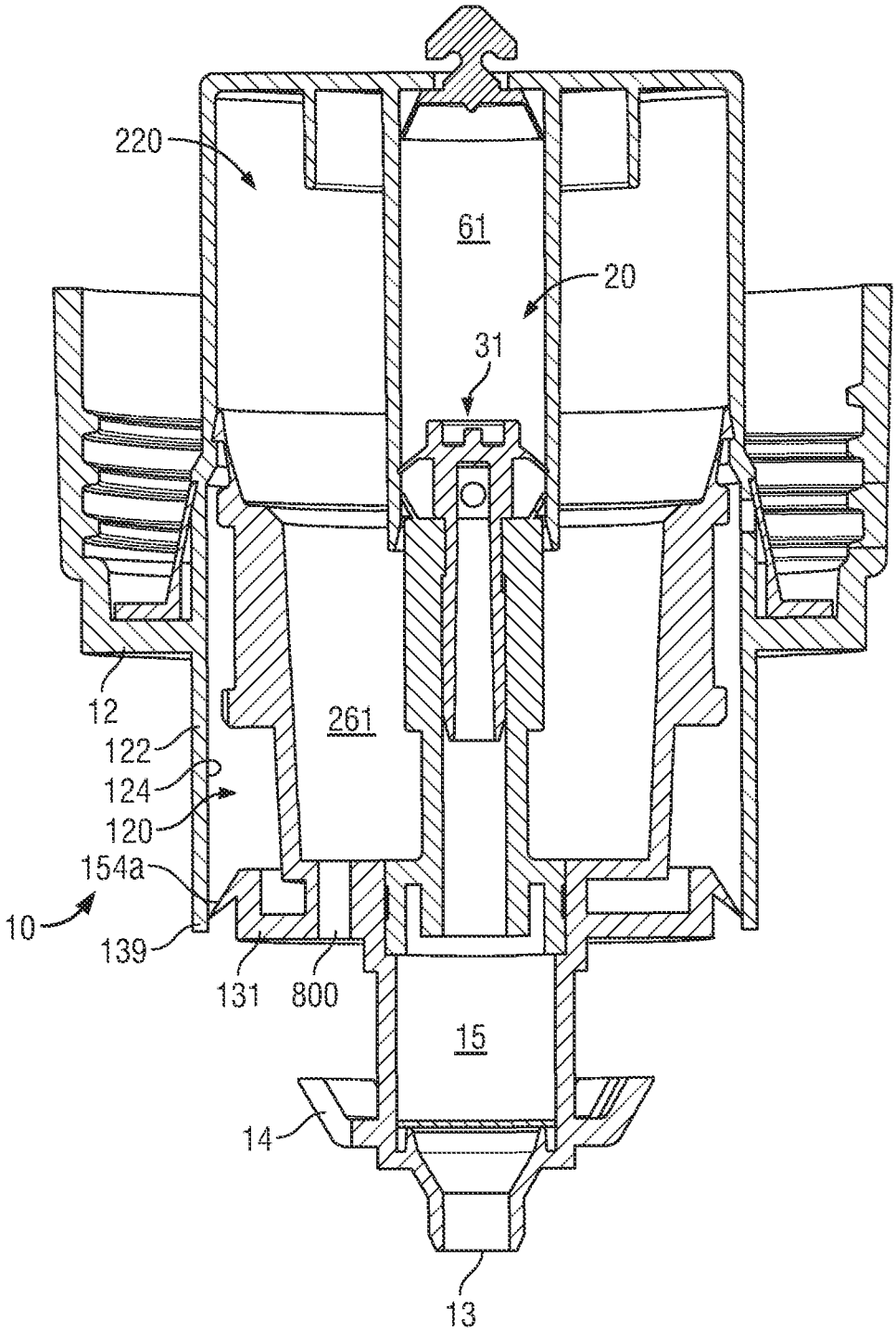
FIG. 15 is a cross-sectional side view of an assembled pump assembly of a sixth embodiment of a pump assembly in accordance with the present invention with the piston in an extended position.

FIG. 15 is a cross-sectional side view of an assembled pump assembly of a sixth embodiment of a pump assembly in accordance with the present invention with the piston in an extended position.

Reference is made to FIG. 15 which shows a pump assembly 10 in accordance with a sixth embodiment of the present invention. The pump assembly 10 shown in FIG. 15 is identical to the embodiment shown in FIG. 13 with the first exception that the air passage ports 520 have been eliminated, a second exception that the foam producing screen is eliminated, with the third exception that a discharge air bypass port 800 is provided such that there is free flow at all times of atmospheric air into and out of the discharge air chamber 261, and with a fourth exception that the seal disc **154*a* extends axially outwardly and radially outwardly as contrasted with the seal disc 154 in the FIGS. 10 to 14 which extends axially inwardly and radially outwardly. The seal disc 154*a* which extends axially outwardly and radially outwardly has an inherent bias such that it is biased into the interior surface 124 of the wall 122 sufficiently to prevent air flow outwardly therepast when the pressure within the replenishing air compartment 161 is less than a desired maximum of, for example, 10 millibar above atmosphere. With these changes, the pump assembly merely has an operative fluid pump 20 and replenishing air pump 120. The discharge air pump 220 is inoperative and does not discharge any air to be discharged out the outlet 13. The pump assembly 10 operates with the fluid pump 20 drawing fluid from the reservoir 11 and discharges the fluid out the outlet without mixing the fluid with air and with the replenishing air pump discharges atmosphere air into the reservoir 11. The volume of fluid drawn from the reservoir in any cycle of operation is preferably equal to the volume of air discharged into the reservoir towards keeping the reservoir from collapsing. FIG. 15 shows a lotion pump assembly particularly useful for dispensing fluids such as liquids that do not foam, creams and lotions such as those which may have a relatively high viscosity. In FIG. 15, the seal disc 154 could be the same as in the embodiments of FIGS. 10 to 14. FIG. 15 is a modification of the foaming pump assembly of FIG. 13** and analogous modification of each of the other foaming pump modifications may be made to disable the discharge air pump. Other arrangements of foaming piston pump assemblies and lotion piston pump assemblies will occur to persons skilled in the art which are adapted to discharge air into the reservoir at least to keep a vacuum from arising.

In each of the embodiments other than the embodiment of FIG. 15, insofar as circumstances may arise that a vacuum condition exists within the reservoir 11, then insofar as the vacuum below atmospheric pressure outside the reservoir 11 is sufficiently large, the vacuum may overcome the resistance of each of the replenishing air outlet valve 130 and replenishing air inlet valve 139 such that air from the atmosphere will flow past each of the one-way replenishing air inlet valve 139 and the one-way replenishing air outlet valve 130 through the air compartment 161 into the reservoir 11 to relieve vacuum. For example, in the first embodiment of FIGS. 2 to 5, in FIG. 2, if a sufficient vacuum condition existed in the reservoir 11, then the vacuum would deflect the seal disc 68 of the one-way replenishing air outlet valve 130 to draw air therepast and create vacuum conditions in the replenishing air compartment 161 which would deflect the seal disc in the one-way replenishing air inlet valve 139 to let atmospheric therepast assuming the piston is held against movement. Preferably, the replenishing air outlet valve 130 and the replenishing air inlet valve 139 would be configured to not permit air flow therepast unless a vacuum condition greater than a minimum threshold relief vacuum may exist of preferably 10 millibar or greater, or 20 millibar or greater or 25 millibar or greater.

In each of the embodiments, insofar as circumstances may arise that a raised pressure condition exists within the reservoir 11, then insofar as the increase in pressure in the reservoir 11 above atmospheric pressure outside the reservoir 11 is sufficiently large, the raised pressure may overcome the resistance of each of the one-way fluid inlet valve 30 and the one-way outlet valve 39 such that fluid will flow past each of the one-way fluid inlet valve 30 and the one-way fluid outlet valve 39 through the fluid compartment 61 to the mixing chamber 15 and possibly out the discharge outlet 13, assuming the piston is held against movement. For example, in the first embodiment of FIGS. 2 to 5, in FIG. 3, if a sufficiently raised pressure condition existed in the reservoir 11, then the raised pressure would deflect the seal disc 68 of the one-way fluid inlet valve 30 to force fluid from the reservoir 11 therepast and create a raised pressure condition in the fluid compartment 61 which would deflect the seal disc 68 in the one-way fluid outlet valve 39 to let fluid flow therepast. Preferably, the fluid outlet valve 39 and the fluid inlet valve 30 would be configured to not permit fluid flow therepast unless a raised pressure condition greater than a minimum threshold discharge pressure may exist of preferably 10 millibar or greater, or 10 millibar or greater, or 15 millibar or greater, or 20 millibar or greater or 25 millibar or greater.

In accordance with the present invention, in each cycle of operation of the piston pump, a volume of the fluid, typically an incompressible liquid, is drawn from the reservoir 11 and a volume of air is injected into the reservoir 11. In accordance with the present invention, the relative volume of the liquid drawn in each stroke and the relative volume of air in each stroke can suitably be selected by the relative sizing and configuration of each of the fluid pump 20 and the replenishing air pump 120. In a first preferred manner of operation of the present invention, the volume of fluid which is drawn from the reservoir 11 in each cycle of operation is equal to the volume of air injected and thus the internal volume in the reservoir 11 and the pressure within the reservoir 11 is maintained constant.

In a second preferred manner of operation of the present invention, the volume of the liquid drawn in a cycle of operation may be selected to be greater than the volume of air injected in each cycle of operation with the effect that after each cycle, the volume within the reservoir 11 will decrease leading to a vacuum condition within the reservoir 11 compared to atmospheric pressure. Such vacuum condition may suitably be controlled as, for example, by having a vacuum relief arrangement which permits air to be drawn into the reservoir when the vacuum exceeds a maximum threshold vacuum.

In a third preferred manner of operation of the present invention, the volume of the liquid drawn in a cycle of operation may be selected to be less than the volume of air injected in each cycle of operation with the effect that after each cycle, the volume within the reservoir 11 will increase leading to a raised pressure condition within the reservoir 11 compared to atmospheric pressure. Providing a raised pressure condition within the reservoir 11 can be advantageous as, for example, to utilize as a reservoir 11 a plastic bag which unless filled or under a positive pressure would collapse. By maintaining a pressure at least equal to atmospheric pressure within such a bag, the bag could maintain a desired preferred appearance yet be made at low cost as, for example, from relatively flexible and/or transparent material. The bag could also be made from material which is resilient and elastic and permits expansion of its volume by stretching of the material from which it is made, preferably with an inherent tendency to return to an inherent condition.

Arrangements can be provided towards preventing the pressure within the reservoir from becoming so large as to be disadvantageous as, for example, to excessively discharge fluid through the fluid inlet and outlet valves or excessively expand or rupture the reservoir. For example, the relative configuration of the one-way fluid inlet valve 30 and the one-way fluid outlet valve 39 may be selected as, for example, to permit controlled fluid flow outwardly therepast to relieve the pressure in the reservoir when the pressure reaches a selected minimum threshold discharge pressure. As a first example, providing a minimum threshold discharge pressure in the range of 10 millibar to 25 millibar can provide an arrangement which would accommodate the pump assembly operating to discharge larger volumes of air into the reservoir than the volumes of liquid which are withdrawn yet maintain an acceptable pressure within the reservoir. As a second example, the replenishing air pump 120 may be configured such that the volume of air that it injects into the reservoir 11 reduces as the pressure within the reservoir 11 increases. For example, in the context of the pump assembly with the first embodiment of FIGS. 2 and 3, the replenishing air piston 131 can be modified to eliminate the axially innermost sealing disc 133 leaving merely the axially outermost sealing disc 133 which extends axially outwardly and radially outwardly and is to be biased into the interior surface 124 of the wall 122 sufficiently to permit air within the replenishing air compartment 161 merely to be increased to a pressure of, for example, 10 millibar above atmosphere and at pressures within the replenishing air compartment 161 above 10 millibar, the axially outermost sealing disc 133 would deflect to let air within the compartment 161 pass outwardly into the discharge air compartment 261. A similar arrangement is shown in the embodiment of FIG. 15 in which the seal disc 154*a* extends axially outwardly and radially outwardly as contrasted with the seal disc 154 in the FIGS. 10 to 14 which extends axially inwardly and radially outwardly. The seal disc 154*a* which extends axially outwardly and radially outwardly has an inherent bias such that it is biased into the interior surface 124 of the wall 122 sufficiently to permit air within the replenishing air compartment 161 merely to be increased to a pressure of, for example, 10 millibar above atmosphere and at pressures within the replenishing air compartment 161 above 10 millibar, the seal disc 154*a* deflects to let air within the compartment 161 pass outwardly to the atmosphere.

Generally, it is considered that the discharge of fluid from the reservoir due to a raised pressure condition within the reservoir is not advantageous. Avoiding fluid discharge due to a raised pressure condition may be accommodated as, for example, by limiting the raised pressure which the replenishing air pump 120 can develop within the reservoir 11 to a value which is less than the minimum threshold discharge pressure under which fluid will pass outwardly. For example, in one preferred embodiment, the capability of the replenishing air pump 120 to pressurize the reservoir might be limited to 10 to 15 millibar and the fluid inlet valve 30 and fluid discharge valve 39 may be selected to have a minimum threshold pressure discharge greater, for example, by at least 5 millibar more than the minimum threshold vacuum and, for example, absolutely in the range of, say, 15 millibar to 25 millibar.

In a typical fluid dispenser, in each stroke of operation, a volume of possibly 1 milliliter of liquid may be drawn from a reservoir which reservoir typically has a volume in the range of 500 milliliters to 1000 milliliters. If, in a cycle of operation, 1.0 ml liquid is discharged from the reservoir and no, for example, 1.1 ml of air is injected, then a vacuum of 0.1 millibar would arise per cycle. Once the pressure in the reservoir might reach a desired maximum pressure threshold of, for example, 10 millibar, the pressure arrangements to prevent the pressure from increasing could operate to keep the pressure below about 10 millibar. If, in a cycle of operation, 1.0 ml liquid is discharged from the reservoir and no, for example, 0.9 ml of air is injected, then a vacuum of 0.1 millibar would arise per cycle. Once the pressure vacuum in the reservoir might reach a desired maximum vacuum threshold of, for example, 10 millibar, the vacuum relief arrangements would prevent the vacuum from increasing could operate to keep the vacuum below about 10 millibar. Whether the operation of the pump assembly is intended to maintain atmospheric pressure, or create and maintain a threshold raised pressure or create and maintain a threshold vacuum in the reservoir, one or both of safety pressure relief arrangements to release pressure if the pressure is raised to a safety pressure greater than any threshold pressure and safety pressure vacuum relief arrangements to release pressure if the vacuum is raised to a safety vacuum greater than any threshold pressure. Preferably, in accordance with the present invention, the volume of fluid drawn from the reservoir in a cycle of operation, the reservoir is in the range of about 5/10to 10/5the volume of the air injected, more preferably, in the range of about 9/10to 10/9.

Figure 2:
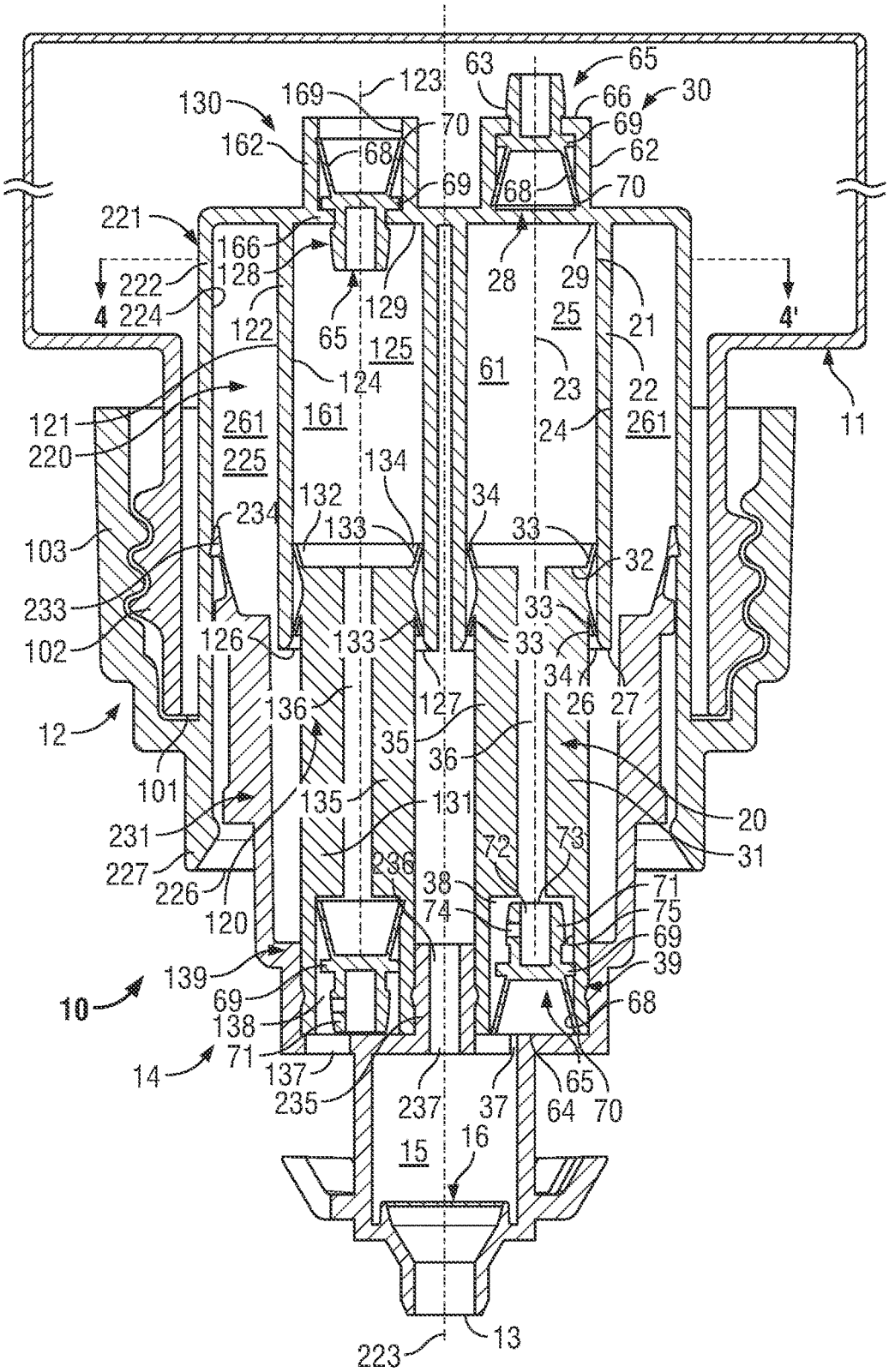
FIG. 2 is a cross-sectional side view of an assembled pump assembly of a first embodiment of a pump assembly in accordance with the present invention with the piston in an extended position.
Figure 3:
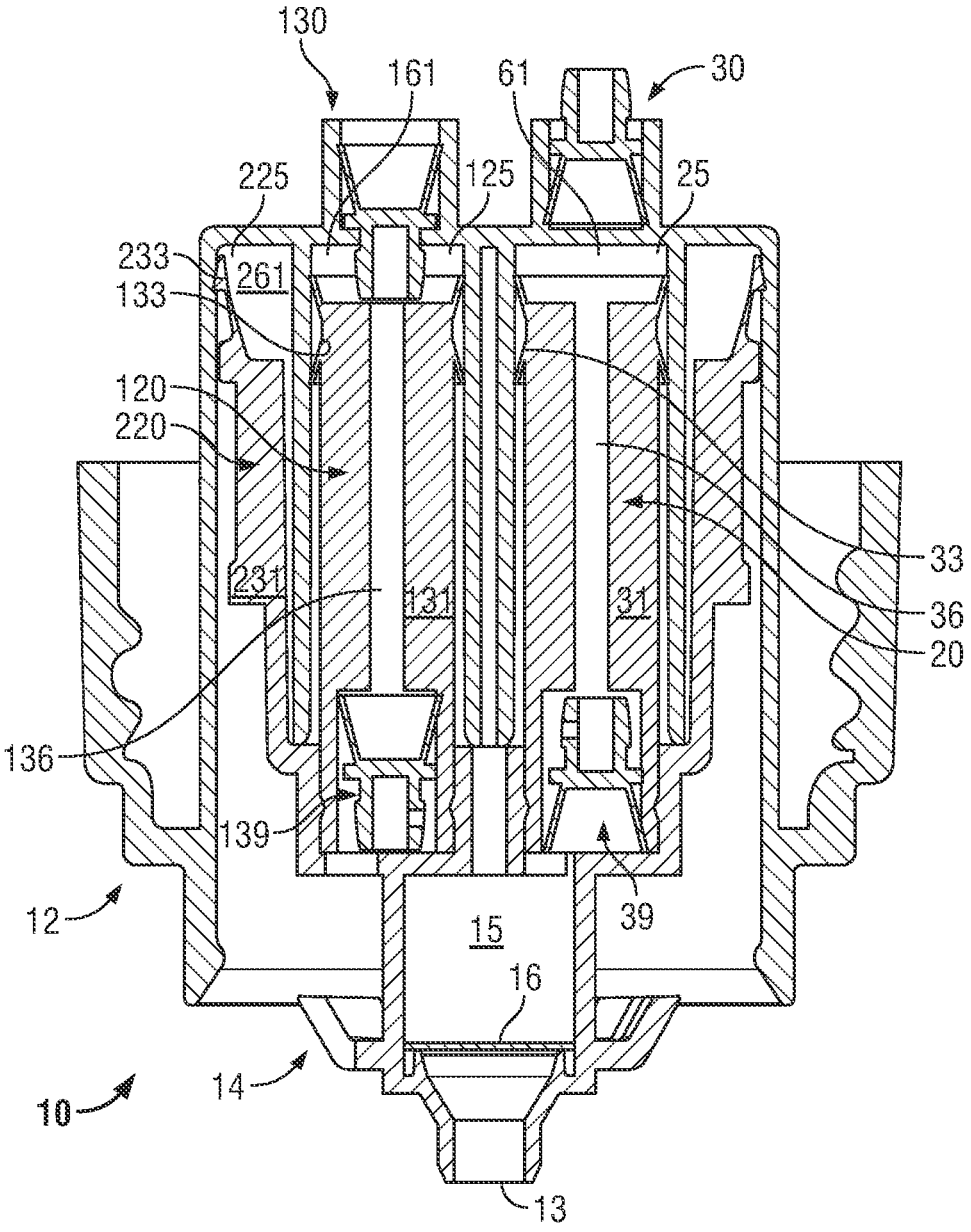
FIG. 3 is a cross-sectional side view of the pump assembly of FIG. 2 with the piston in a fully retracted position.

Pumps in accordance with the present invention preferably have a mechanism for preventing the piston 14 from moving outwardly as, for example, past a fully extended position. In this regard, stop members are illustrated, for example, in FIG. 2 as carried on the body 12 to engage the piston 14 and stop movement of the piston outwardly past the extended position as shown in FIG. 2. Additionally, when the pump assembly 10 may be assembled in any dispenser such that, for example, an actuator which may engage the piston 14 may engage the piston 14 in a manner that prevents axial outward movement past a maximum extended position which may be different and outwardly from the fully extended position.

In accordance with the present invention, in one preferred arrangement, it is desired that fluid not be able to be discharged from the reservoir 11 when the piston is in a fully extended position, then configurations can be provided such that on the piston reaching a fully extended position, elements of the liquid pump interact to prevent fluid flow outwardly through the fluid pump.

Figure 16:
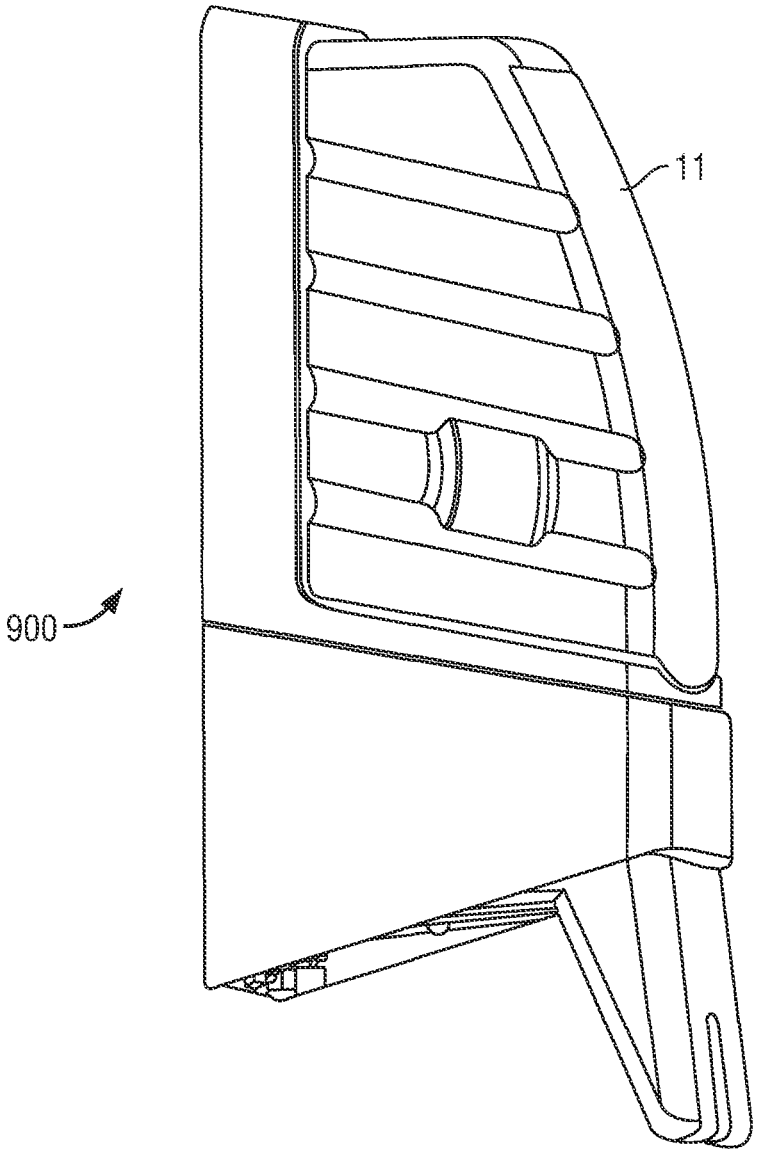
FIG. 16 is a pictorial view of a left side of a dispenser with a visible bottle utilizing a pump assembly in accordance with the present invention.
Figure 17:
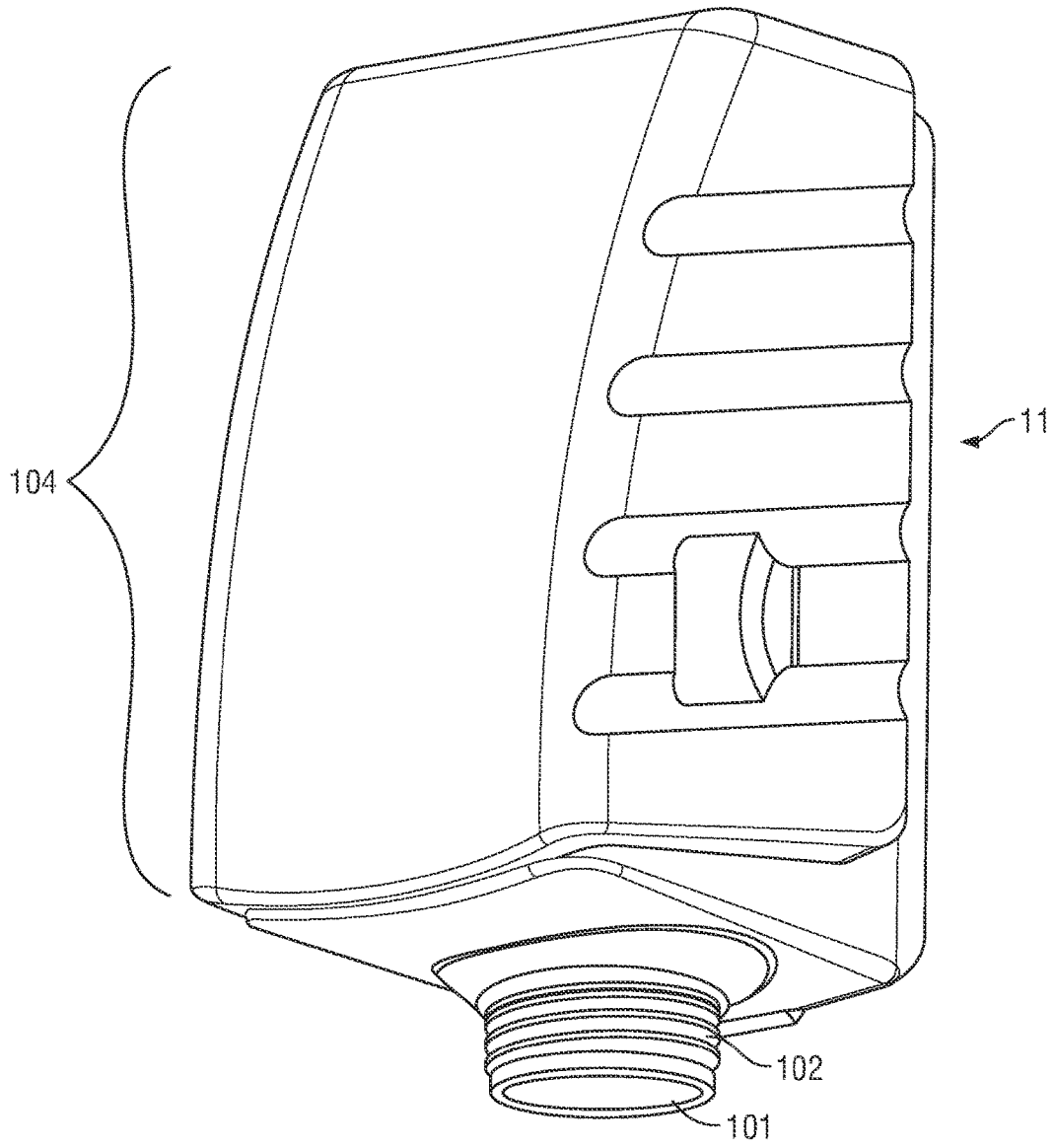
FIG. 17 is a pictorial view of a right side of the bottle of the dispenser of FIG. 16.

Reference is made to FIGS. 16 and 17 which show a dispenser 900 and a bottle or reservoir 11 for the dispenser 900 in accordance with U.S. Pat. No. 7,748,574 to Ophardt, issued Jul. 6, 2010, however, in which a pump assembly in accordance with one of the embodiments of this invention as herein earlier disclosed but not shown on FIG. 16 or 17 is provided within the dispenser 900 and the pump assembly is operative to draw liquid from the reservoir 11 and discharge atmospheric air into the reservoir 11. The reservoir 11 is preferably formed from plastic and is open only at its opening 101. In use of the dispenser 900, the reservoir 11 is visible to a user. The reservoir 11 has a threaded neck 102 and a hollow cavity-forming body 104 connected to the neck 102. The reservoir 11 can be manufactured to provide the body 104 to suitably resist or permit deformation of the body 104 under varying pressure conditions that may arise within the reservoir 11 as contrasted with atmospheric pressure outside the reservoir. Ability of the body 104 of the reservoir 11 to collapse under vacuum conditions in the reservoir or to expand under elevated pressure conditions as may be desired may be controlled by suitable selection factors including the nature of the materials, preferably plastic, from which the reservoir is made, the method of manufacture, the construction of the reservoir, the relative thickness of the walls of the reservoir at any location on the reservoir 11 and the shape of the reservoir 11 including the extent that reinforcing structures may be incorporated into the walls of the reservoir 11 which may assist in either resisting deformation of the walls of reservoir 11 or assist in permitting deformation as the pressure within the reservoir may change relative to atmospheric pressure. When the reservoir is made from plastic, if the reservoir 11 is to be capable of substantially resisting collapse under relatively large vacuum conditions, then the walls of the reservoir and its reinforcing ribs and structures typically need to be relatively thick and robust. However, when a pump assembly in accordance with the present invention is used and vacuum conditions are substantially prevented from arising within the reservoir 11, then the walls of the reservoir and its reinforcing ribs and structures can be made to be relatively thin and less robust. For example, using less plastic material and reducing cost.

Operation of the dispenser assemblies of this invention under relatively steady state pressure conditions in the reservoir whether at atmospheric pressure, or a desired vacuum condition or a desired pressure condition is advantageous such that the piston pump can, in each cycle of operation in which the piston is moved between a set extended position to a set retracted position, dispense an accurate constant dose of fluid.

While the invention has been described with reference to preferred embodiments, many modifications and variations will occur to persons skilled in the art. For a definition of the invention, reference is made to the following claims.

We claim:

1. A dispenser for dispensing fluid from a container comprising:

a container having a container outlet opening, the container closed other than the container outlet opening, a fluid in the container, a pump mechanism including a fluid pump and a replenishing air pump, the fluid pump in communication with fluid in the container through the container outlet opening, the fluid pump receiving the fluid from the container and discharging the fluid from the container out a discharge outlet, the fluid pump comprising a piston pump with a fluid piston and a fluid chamber casing forming a fluid chamber within which the fluid piston is reciprocally slidable relative the fluid chamber casing along a fluid axis in a cycle of operation to draw the fluid from the container and discharge the fluid out the discharge outlet, the fluid pump in communication with fluid in the container through the container outlet opening, the fluid pump receiving the fluid from the container and discharging the fluid from the container out the discharge outlet, the replenishing air pump comprising a piston pump with a replenishing air piston and a replenishing air chamber casing forming a replenishing air chamber within which the replenishing air piston is reciprocally slidable along a replenishing air axis in the cycle of operation to draw air from the atmosphere and discharge the air into the container via the outlet opening, the fluid axis and the replenishing air axis are parallel, the replenishing air piston is fixed to the fluid piston for movement in unison together, the replenishing air chamber casing is fixed to the fluid chamber casing for movement in unison together.

2. A dispenser as claimed in claim 1 wherein the dispenser dispenses the fluid onto a person's hand.

3. A dispenser as claimed in claim 2 wherein the fluid is selected from the group consisting of cleaning fluids, disinfecting fluids, and hand creams.

4. A dispenser as claimed in claim 1 wherein, in the cycle of operation, the fluid pump draws a volume of fluid from the container and the replenishing air pump discharges into the container a volume of air approximately equal to the volume of fluid such that a sum of a volume of the fluid within the container and a volume of air in the container after successive of the cycle of operation is maintained relatively constant.

5. A dispenser as claimed in claim 1 wherein, in the cycle of operation of the pump mechanism, the replenishing air pump discharges into the container a volume of air and the fluid pump draws a volume of fluid from the container less than the volume of air such that a sum of a volume of the fluid within the container and a volume of air in the container after successive of the cycle of operation is a raised pressure above atmospheric pressure, and the dispenser includes a pressure relief arrangement to prevent the pressure in the container from increasing above the raised pressure.

6. A dispenser as claimed in claim 1 wherein, in the cycle of operation, the replenishing air pump discharges into the container a volume of air and the fluid pump draws a volume of fluid from the container greater than the volume of air such that a sum of a volume of the fluid within the container and a volume of air in the container after successive of the cycle of operation is a vacuum below atmospheric pressure, the dispenser including a vacuum relief arrangement to prevent the vacuum in the container from increasing above a maximum vacuum threshold.

7. A dispenser as claimed in claim 1 wherein, in the cycle of operation, when the pressure within the container is less than a threshold pressure above atmosphere, the replenishing air pump discharges into the container a volume of air greater than the volume of fluid and when the pressure within the container is equal to or greater than the threshold pressure above atmosphere, the replenishing air pump does not discharge air into the container.

8. A dispenser as claimed in claim 7 including at least one of (a) a pressure relief arrangement to prevent the pressure in the container from increasing above a safety pressure threshold above atmospheric pressure, and (b) a vacuum relief arrangement to prevent the pressure in the container from decreasing to below a vacuum safety threshold below atmospheric pressure.

9. A dispenser as claimed in claim 1 wherein:

the cycle of operation consists of a first stroke and an opposite second stroke, A. the replenishing air pump discharges the air into the container via the outlet opening in the first stroke during which first stroke the fluid pump discharges the fluid from the discharge outlet, and B. the replenishing air pump draws in the air in the second stroke during which second stroke the fluid pump draws the fluid from the container.

10. A dispenser as claimed in claim 9 wherein the first stroke is a retraction stroke and the second stroke is a withdrawal stroke.

11. A dispenser as claimed in claim 10 wherein:

the fluid pump includes a one-way fluid inlet valve and a one-way fluid outlet valve, and the replenishing air pump includes a one-way replenishing air inlet valve and a one-way replenishing air outlet valve.

12. A dispenser as claimed in claim 10 wherein the replenishing air chamber is a stepped chamber having a replenishing air inner chamber portion coaxial with a replenishing air outer chamber portion, the replenishing air inner chamber portion having a diameter different than a diameter of the replenishing air outer chamber portion.

13. A dispenser as claimed in claim 1 wherein the pump mechanism further includes a discharge air pump, the discharge air pump comprising a piston pump with a discharge air piston and a discharge air chamber casing forming a discharge air chamber within which the discharge air piston is reciprocally slidable along a discharge air axis in the cycle of operation to draw air from the atmosphere and discharge the air out the discharge outlet, the fluid axis and the discharge air axis are parallel, the discharge air piston is fixed to the fluid piston for movement in unison together, the discharge air chamber casing is fixed to the fluid chamber casing for movement in unison together.

14. A dispenser as claimed in claim 13 wherein the fluid is a liquid capable of foaming and the air discharged from the discharge air pump and the fluid from the fluid pump are simultaneously passed through a foam generator to produce foam.

15. A dispenser as claimed in claim 14 wherein:

A. the replenishing air pump discharges the air into the container via the outlet opening while the fluid pump discharges the liquid from the discharge outlet, and B. the replenishing air pump draws in the air while the fluid pump draws the liquid from the container.

16. A dispenser as claimed in claim 1 wherein:

the pump mechanism further includes a discharge air pump, the discharge air pump comprising a piston pump with a discharge air piston and a discharge air chamber casing forming a discharge air chamber within which the discharge air piston is reciprocally slidable along a discharge air axis in the cycle of operation to draw air from the atmosphere and discharge the air out the discharge outlet, the fluid axis and the discharge air axis are parallel, the discharge air piston is fixed to the fluid piston for movement in unison together, the discharge air chamber casing is fixed to the fluid chamber casing for movement in unison together, the cycle of operation consists of a retraction stroke and an opposite withdrawal stroke, A. the discharge air pump discharges the air from the discharge outlet in the retraction stroke during which retraction stroke the fluid pump discharges the fluid from the discharge outlet, and B. the discharge air pump draws in the air in the withdrawal stroke during which withdrawal stroke the fluid pump draws the fluid from the container.

17. A dispenser as claimed in claim 16 wherein the fluid is a liquid capable of foaming and the air discharged from the discharge air pump and the fluid from the fluid pump are simultaneously passed through a foam generator to produce foam, A. the replenishing air pump discharges the air into the container via the outlet opening in the retraction stroke, and B. the replenishing air pump draws in the air in the withdrawal stroke.

18. A dispenser as claimed in claim 1 wherein:

the cycle of operation consists of a retraction stroke and an opposite withdrawal stroke, A. the replenishing air pump discharges the air into the container via the outlet opening in the retraction stroke during which retraction stroke the fluid pump discharges the fluid from the discharge outlet, and B. the replenishing air pump draws in the air in the withdrawal stroke during which withdrawal stroke the fluid pump draws the fluid from the container, wherein in the cycle of operation the fluid pump draws a volume of fluid from the container and the replenishing air pump discharges into the container a volume of air approximately equal to the volume of fluid.

19. A dispenser as claimed in claim 18 including at least one of (a) a pressure relief arrangement to prevent the pressure in the container from increasing above a safety pressure threshold above atmospheric pressure, and (b) a vacuum relief arrangement to prevent the pressure in the container from decreasing to below a vacuum safety threshold below atmospheric pressure.

20. A dispenser as claimed in claim 13 wherein the fluid axis, the replenishing air axis and the discharge air axis are coaxial, the dispenser including a piston chamber-forming body disposed about the fluid axis, the piston chamber-forming body having an inner tubular casing member and a stepped diameter outer tubular casing member coaxially about the inner tubular casing member, the inner tubular casing member extending axially from an axially inner end to an open axially outer end, the axially inner end of the inner tubular casing member in communication with fluid in the container, the fluid chamber provided within the inner tubular casing member, the outer tubular casing member extending axially from a closed axially inner end to an open axially outer end, the outer tubular casing member having a circumferential wall with a radially inwardly directed inner surface, the outer tubular casing member having an axially inner chamber portion of a first diameter closed at the closed axially inner end and opening axially outwardly into an outer chamber portion of a second diameter greater than the first diameter, the outer chamber portion open axially outwardly to the open axially outer end, the discharge air chamber defined within the inner chamber portion, the replenishing air chamber defined as a stepped chamber formed bridging the inner chamber portion and the outer chamber portion, a piston-forming member carrying the fluid piston, the replenishing air piston and the discharge air piston, the piston-forming member coaxially received in the piston chamber-forming body for reciprocal sliding in the cycle of operation, the piston-forming member having a stem extending along the fluid axis from an axially inner end to an axially outer end, a central passageway through the stem closed at an axial inner end and open at an axially outer end as the discharge outlet, an axially inward portion of the stem comprising the fluid piston, the fluid pump discharging fluid via a fluid outlet port through the stem into the central passageway, an air discharge disc extending radially outwardly from the stem axially outwardly of the fluid piston to a distal end in sealing engagement with the radially inwardly directed inner surface in the inner chamber portion, a variable volume discharge air compartment of the discharge air pump defined axially inwardly and radially inwardly of the air discharge disc, the discharge air pump discharging air from the variable volume discharge air compartment via a discharge air port through the stem into the central passageway, an air replenishing disc extending radially outwardly from the stem axially outwardly of the air discharge disc to a distal end in sealing engagement with the radially inwardly directed inner surface in the outer chamber portion, a variable volume replenishing air compartment of the replenishing air pump defined within the replenishing air chamber axially between the discharge air disc and the replenishing air disc, a replenishing air port through the wall of the outer tubular casing member between the air discharge disc and the air replenishing disc in communication with the container via the container outlet opening, the replenishing air pump discharging air from the variable volume replenishing air compartment through the replenishing air port to the container via the container outlet opening.

21. A dispenser as claimed in claim 1 wherein the fluid axis and the replenishing air axis are coaxial.

* * * * *